US011370225B2

(12) United States Patent
Luke et al.

(10) Patent No.: US 11,370,225 B2
(45) Date of Patent: Jun. 28, 2022

(54) DISPENSING APERTURE HOODS

(71) Applicant: Hewlett-Packard Development Company, L.P., Spring, TX (US)

(72) Inventors: Jeffrey H. Luke, Boise, ID (US); Mathew Lavigne, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 49 days.

(21) Appl. No.: 16/973,122

(22) PCT Filed: Nov. 15, 2018

(86) PCT No.: PCT/US2018/061226

§ 371 (c)(1),
(2) Date: Dec. 8, 2020

(87) PCT Pub. No.: WO2020/101685

PCT Pub. Date: May 22, 2020

(65) Prior Publication Data

US 2021/0252872 A1 Aug. 19, 2021

(51) Int. Cl.

| | |
|---|---|
| ***B41J 2/175*** | (2006.01) |
| ***B41J 2/14*** | (2006.01) |
| ***B05B 1/32*** | (2006.01) |

(52) U.S. Cl.

CPC ..... *B41J 2/17596* (2013.01); *B05B 1/326* (2013.01); *B41J 2/14* (2013.01); *B41J 2/17509* (2013.01); *B41J 2/17523* (2013.01)

(58) Field of Classification Search

CPC . B41J 2/14; B41J 2/175; B41J 2/17506; B41J 2/17509; B41J 2/17523;

(Continued)

(56) References Cited

U.S. PATENT DOCUMENTS

| | | | |
|---|---|---|---|
| 3,680,605 | A | 8/1972 | Nigro |
| 4,635,850 | A | 1/1987 | Leisi |

(Continued)

FOREIGN PATENT DOCUMENTS

| | | | |
|---|---|---|---|
| CN | 105404117 | A | 3/2016 |
| WO | WO 2009/020393 | A1 | 2/2009 |

*Primary Examiner* — Anh T Vo

(74) *Attorney, Agent, or Firm* — Jefferson IP Law, LLP

(57) ABSTRACT

An example of a device (100) may include a valve body (108). The device (100) may include a printing substance transfer aperture (122) through the valve body (108). The device (100) may include a hood (138), fixed to the valve body (108), encompassing the printing substance transfer aperture (122) within a cavity between an external face (137) of the valve body (108) and the hood (138). The device (100) may include a printing substance dispensing nozzle (110) movable between a first position with an orifice (126) of the printing substance dispensing nozzle (110) facing an internal face of the valve body (108) and a second position with the orifice (126) of the printing substance dispensing nozzle (110) facing the printing substance transfer aperture (122). The device (100) may include a dispensing-side gasket material (132) slide-able through the printing substance transfer aperture (122) when moving the printing substance dispensing nozzle (110) between the first position and the second position.

15 Claims, 9 Drawing Sheets

(58) Field of Classification Search
CPC ..... B41J 2/17596; B05B 1/28; B05B 1/326; B05B 9/0413; G03G 15/0886
See application file for complete search history.

(56) References Cited

U.S. PATENT DOCUMENTS

| | | | | |
|---|---|---|---|---|
| 5,074,342 | A | 12/1991 | Kraehn | |
| 5,383,603 | A | 1/1995 | Englhard et al. | |
| 5,838,353 | A | 11/1998 | Choi | |
| 5,903,292 | A | 5/1999 | Scheffelin et al. | |
| 6,209,995 | B1 | 4/2001 | Grune et al. | |
| 6,862,420 | B1 | 3/2005 | Less | |
| 7,043,173 | B2 | 5/2006 | Grune et al. | |
| 7,412,192 | B2 | 8/2008 | Nakajima et al. | |
| 7,711,293 | B2 | 5/2010 | Koyama | |
| 9,126,415 | B2 * | 9/2015 | Sasaki | B41J 2/17509 |
| 2005/0195246 | A1 | 9/2005 | Ogawa | |
| 2005/0195254 | A1 * | 9/2005 | Takagi | B41J 2/17506 347/85 |
| 2007/0019987 | A1 | 1/2007 | Miller | |
| 2010/0072230 | A1 | 3/2010 | Hatch | |
| 2017/0217614 | A1 | 8/2017 | Franz | |

* cited by examiner

DISPENSING APERTURE HOODS

BACKGROUND

A variety of containers may be utilized to contain, store, transport, and/or transfer substances. Dispensable substances may be transferred between such containers. A dispensing container and a receiving container may include complementary mating interfaces. Leaks, spills, residual buildup, and/or contamination of a dispensable substance may occur at the mating interfaces of the containers.

DETAILED DESCRIPTION

Figure 1:
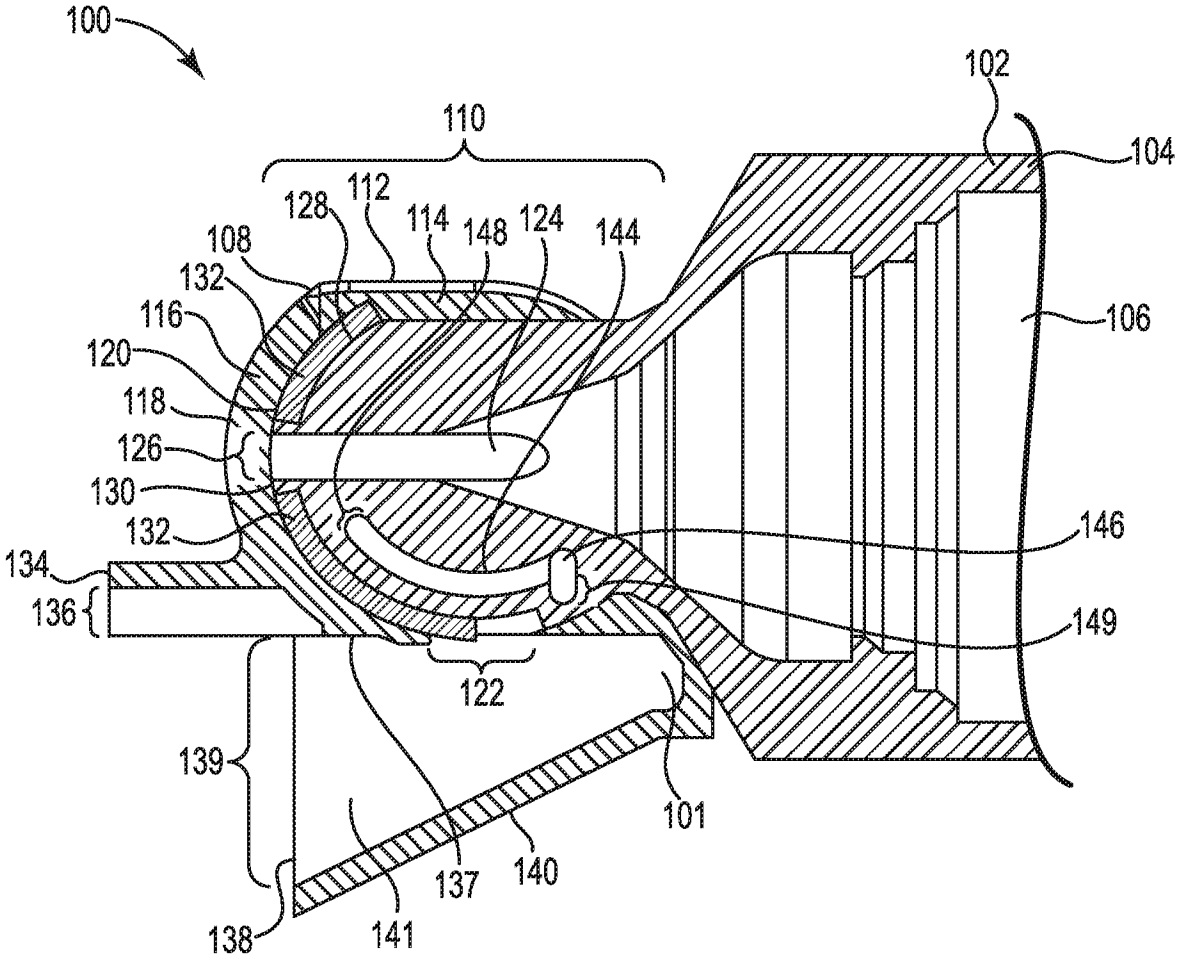
FIG. 1 illustrates a cross-sectional view of an example of a device with a with a dispensing aperture hood consistent with the disclosure.

A container may be utilized to contain, store, transport, and/or transfer various substances. For example, a container may be utilized to contain, store, transport, and/or transfer a printing substance. For example, a printing device may utilize a printing substance to generate a printed material. A printing device may include a device that utilizes digital and/or electronic input to generate, with the printing substance, a physical instantiation of the input as printed material. A wide variety of printing devices exist including inkjet printers, laser printers, three dimensional (3D) printers, etc. As such, a wide variety of printing substances exist such as a liquid printing ink, a printing toner powder, and/or three-dimensional printing substance, etc.

A printing device may utilize a container to act as a reservoir or supply container of printing substance. Further, containers may be utilized to refill a reservoir or supply container of a printing substance.

Containers utilized to contain, store, transport, and/or transfer a printing substance may be configured to contain the printing substances in a manner that excludes the external environment from the printing substance and vice versa. Excluding the printing substance from the external environment may preserve the printing substance, the environment, the health of a user, the functionality of the printing device, and/or the functionality of the container.

For example, a printing substance may be modified and/or degraded by exposure to environmental contaminants. Such contaminants may include particulate matter, reactants, atmosphere, gases, liquids, solids, etc. A container may block exposure of the printing substance to such contaminants.

Further, if contaminants are introduced to a printing substance, the contaminants may become resident in the printing substance and/or the container. Some printing devices may include mechanical, electrical, and/or chemical components that may be damaged or degraded as a result of encountering the contaminants. Therefore, when a contaminated printing substance is utilized by the printing device in a printing operation, the contaminants may encounter the components and cause the printing device to sustain damage and/or malfunction.

Furthermore, the printing substance itself may become a contaminant to a printing device, a user of the printing device, and/or the environment of a printing device. For example, if the printing substance is spilled or leaked outside of a container it may encounter and/or build up on the components of the printing device. This exposure and/or build up may result in a mess and/or in damage to the components.

In another example, spilling or leaking the printing substance outside of the container where a user may encounter them may result in a mess and/or damage to a user's health. In another example, spilling or leaking the printing substance outside of the container into the environment may cause a mess and/or damage to the environment.

As such, some containers may be configured to maintain the printing substance sealed within walls of the container. The print substance may be sealed within the walls of the container in a manner that excludes the above-described contaminants. For example, a container may be completely sealed or capped with the print substance inside of it.

However, on some occasions the printing substance may be transferred from one container to another. For example, a printing device may include a container such as a printing substance supply cartridge. The print substance supply cartridge may serve as a reservoir for the printing substance until a time when the printing substance is to be utilized by the printing device to perform a printing operation. For example, a printing device may include a printing substance supply cartridge that directly supplies the printing substance to a printing head or other printing mechanism of the printing device without intermediaries and/or conduits.

The supply cartridge of the printing device may also be configured to operate as a receiving container. As a receiving container a supply cartridge may receive printing substance from a dispensing container. For example, a supply cartridge of the printing device may be fillable and/or refillable with a printing substance from a dispensing container.

A dispensing container may include a container to contain a print substance during shipping, storage, and prior to being dispensed into the receiving container. For example, a dispensing container may include a print substance refill container to refill the supply cartridge of the printing device. A printing substance may be transferred from the dispensing container into the supply cartridge.

The dispensing container and the receiving container may include complementary interfaces to achieve and/or maintain alignment during the transfer of a printing substance. The interfaces may include openings in the dispensing container and in the receiving container that allow for the printing substance to pass from the dispensing container into the receiving container. These openings, and the interfaces in general, may be points at which the containers leak printing substance and are exposure points for environmental contaminants.

Various sealing mechanisms such as trap doors, screw caps, and/or pressure valves may be utilized to seal the openings. However, such mechanisms are imprecisely actuated, are cumbersome, do not address premature dispensing of a printing substance, do not address residual printing substance left after the transfer, do not address late dispensing of a printing substance, and/or operate regardless of alignment between the openings of the interfaces.

Moreover, sealing mechanisms that seal such openings may be subject to damage. For example, prior to or during the mating of an opening to a receiving container, a sealing mechanism such as a gasket may be damaged by inadvertent and/or improper contact with objects and/or substances. For example, a user may inadvertently or improperly cause contact between the sealing mechanism and an object or substance that will damage the ability of the sealing mechanism to seal leading to leaks and/or contamination.

As described above, the sealing mechanisms may not be protected from improper or inadvertent contact that may damage the sealing functionality. Part of this failure may include a failure to prevent non-specific contact between objects and sealing mechanisms. That is, by not restricting the type of objects that can make contact with the sealing mechanism, the sealing mechanism may be subject to damage and even improper actuation of a printing substance dispensing mechanism from foreign objects. In an example, the accommodation of non-specific contact between a sealing mechanism and an object can lead to mistakes or improper applications such as mating a dispensing container to an improper or incompatible receiving container, which may result in damage to the dispensing container, the sealing material, the receiving container, and/or mechanisms such as printing devices paired with the receiving container.

In contrast, examples of the present disclosure may include devices and systems including dispensing hoods that may shelter a printing substance transfer aperture, maintain alignment and sealing of a dispensing container until an interface of the dispensing container is mated with an interface of the receiving container, and/or operates as part of a mechanical keying interface to define a geometry of a receiving-side mating interface. The systems and mating devices may operate to keep the printing substance sealed within the dispensing container until apertures through the dispensing-side interface and the receiving side interface are in alignment.

For example, a device of the present disclosure may include a valve body. The device may include a print substance transfer aperture through the valve body. The device may include a hood, fixed to the valve body, encompassing the printing substance transfer aperture within a cavity between an external face of the valve body and the hood. The device may include a printing substance dispensing nozzle movable between a first position with an orifice of the printing substance dispensing nozzle facing an internal face of the valve body and a second position with the orifice of the printing substance dispensing nozzle facing the printing substance transfer aperture. The device may include a dispensing-side gasket material slide-able through the printing substance transfer aperture when moving the printing substance dispensing nozzle between the first position and the second position.

FIG. 1 illustrates a cross-sectional view of an example of a device 100 with a dispensing aperture hood consistent with the disclosure. The device 100 may include a dispensing-side mating interface 101. The dispensing-side mating interface 101 may include an interface for mating a print substance dispensing container 102 to a print substance receiving container (not illustrated in FIG. 1).

The device 100 may include a print substance dispensing container 102. The print substance dispensing container 102 may include a print substance reservoir. For example, the print substance dispensing container 102 may include a print cartridge refilling device.

The print substance dispensing container 102 may include a wall 104. The wall 104 may encompass and/or define a channel 106 of the print substance dispensing container 102. Dispensable printing substance may be contained within the channel 106. The wall 104 may separate the printing substance within the channel 106 from the external environment.

The device 100 may include a valve body 108. The valve body 108 may include a plurality of walls. The plurality of walls of the valve body 108 may encompassing and/or define a cavity of the valve body 108.

The plurality of walls may include a pair of substantially parallel sidewalls separated by the cavity. An example of a sidewall 112 may include an internal face 114 and an external face. The external face of a sidewall 112 of the valve body 108 may face away from the cavity and into the environment. The internal face 114 of the sidewall 112 may face in an opposite direction from the external face of the sidewall 112. For example, internal face 114 of the sidewall 112 may face into the cavity of the valve body 108. The internal face 114 of the sidewall 112 may be substantially planar and/or flat, creating a substantially planar and/or flat interface with the cavity of the valve body 108.

The plurality of walls may also include a front wall 116. The font wall 116 may be a wall that spans between and connects the parallel sidewalls of the valve body 108. The front wall 116 may be substantially perpendicular to the sidewalls between which it spans. The front wall 116 may, in combination with the sidewalls, encompass and/or define the cavity of the valve body 108.

For example, the front wall 116 may include an internal face 120 and an external face 118. The external face 118 of the front wall 116 may face away from the cavity of the valve body 108 and into the environment. The external face 118 of the front wall 116 may be a substantially convex curved surface.

In contrast, the internal face 120 of the front wall 116 may face in an opposite direction from the external face 118. For example, internal face 120 of the front wall 116 may face into the cavity of the valve body 108. The internal face 120 of the front wall 116 may be a substantially concave curved surface. As such, when viewed from the front wall 116, the valve body 108 may have the appearance of a partial cylinder or prism with a convex external face 118 and/or concave internal face 120 of the front wall 116 spanning between the two substantially parallel sidewalls. The front wall 116 may terminate prior to extending all the way around the periphery of the valve body 108 cavity. That is, an opening spanning between the sidewalls may exist between the cavity of the valve body 108 and the external environment.

The valve body 108 may include a print substance transfer aperture 122. The print substance transfer aperture 122 may include a window through the valve body 108. The print substance transfer aperture 122 may be separate from the opening described above. The print substance transfer aperture 122 may be separated from the opening described above by a portion of the front wall 116. The print substance transfer aperture 122 may include an opening spanning through the valve body 108. The print substance transfer aperture 122 may extend through the front wall 116 into the cavity of the valve body 108. The print substance transfer aperture 122 may serve as a conduit for print substance transfer between the cavity of the valve body 108 and a print substance receiving container outside of the valve body 108.

The device 100 may include a printing substance dispensing nozzle 110. A print substance dispensing nozzle 110 may include an internal wall shaped to control the direction and/or characteristics of the flow of a printing substance. For example, the printing substance dispensing nozzle 110 may include a wall within a body of a printing substance dispensing nozzle that directs the flow of print substance from the printing substance dispensing container 102.

In some examples, the walls of the printing substance dispensing nozzle 110 may encompass and/or define a nozzle channel 124. The nozzle channel 124 may have a smaller volume and/or diameter than the channel 106 of the printing substance dispensing container 102. The nozzle channel 124 may be encased inside of a body of the printing substance dispensing nozzle 110. The body of the printing substance dispensing nozzle 110 may include a plurality of external walls in addition to the internal walls defining the nozzle channel 124

In some examples, the internal walls of the printing substance dispensing nozzle 110 may converge to an orifice 126. The orifice 126 in the print substance dispensing nozzle 110 may be an opening through which printing substance is expelled. For example, the internal walls of the printing substance dispensing nozzle 104 may direct the flow of a printing substance from the channel 106 of the printing substance dispensing container 102 through the nozzle channel 124 and out of the orifice 126 when the orifice is not obstructed.

The orifice 126 of the print substance dispensing nozzle 110 may be an orifice 126 through an external wall of the printing substance dispensing nozzle 110. For example, the orifice 126 may include an opening through a front wall 128 of the body of the printing substance dispensing nozzle 110. The front wall 128 of the print substance dispensing nozzle 110 may include a substantially convexly curved external wall. The convexly curved external surface of the front wall 128 may have a complementary geometry to the geometry of the concavely curved internal face 120 of the front wall 116 of the valve body 108. The front wall 128 of the body of the printing substance dispensing nozzle 110 may be perpendicular to and span between two substantially planar and/or flat parallel sidewalls of the body of the printing substance dispensing nozzle 110.

The printing substance dispensing nozzle 110 may occupy the cavity of the valve body 108. That is, the printing substance dispensing nozzle 110 may be fit within the front wall 116 and the sidewalls of the valve body 108. A portion of the printing substance dispensing nozzle 110 opposite the orifice 126 may protrude from the cavity of the valve body 108 through the opening between the two terminuses of the front wall 116 of the valve body 108. That is, a portion of the printing substance dispensing nozzle 110 may protrude from the cavity of the valve body 108 through the opening between the sidewalls of the valve body 108 where the front wall 116 is absent.

The protruding portion of the printing substance dispensing nozzle 110 may maintain fluid communication between the nozzle channel 124 and the channel 106 of the print substance dispensing container 102. As such, the printing substance dispensing container 102 may be contiguous with the printing substance dispensing nozzle 110. Accordingly, the printing substance dispensing container 102 may be utilized as a printing substance reservoir outside of the valve body 108 to supply print substance to the printing substance dispensing nozzle 110 within the valve body 108.

The printing substance dispensing nozzle 110 may be fixed within the cavity of the valve body 108. For example, the printing substance dispensing nozzle 110 may be press fit or friction fit within the cavity of the valve body 108. The printing substance dispensing nozzle 110 may be fixed within the valve body 108 such that the removal of the printing substance dispensing nozzle 110 would involve the application of forces outside of the forces encountered when rotating the printing substance dispensing nozzle 110 within the valve body 108, as described below.

In an example, the printing substance dispensing nozzle 110 may be fixed within the valve body by a male-female connection between a protrusion off of an external wall of the printing substance dispensing nozzle 110 a complementary window or recess in the sidewall 112 of the valve body 108. For example, cylindrical protrusions may protrude outward from the external surface at an approximate center of the sidewalls of the printing substance dispensing nozzle 110. The cylindrical protrusions may mate into a complementary window or recess in the sidewalls of the valve body 108 to fix the printing substance dispensing nozzle 110 within the cavity of the valve body 108.

Although the printing substance dispensing nozzle 110 may be fixed with respect to removal from the cavity of the valve body 108, the printing substance dispensing nozzle 110 may be rotatable within the valve body 108. For example, the printing substance dispensing nozzle 110 may be rotatable within the cavity of the valve body 108 about a rotational axis. The rotational axis may extend through a center of the cylindrical protrusions off of the sidewalls. The rotational axis may be perpendicular with respect to a longitudinal length of the nozzle channel 124 and/or may bisect the nozzle channel 124 perpendicular to the longitudinal length of the nozzle channel 124.

The printing substance dispensing nozzle 110 may be rotated by application of a force to the printing substance dispensing container 102. For example, a user may grasp the print substance dispensing container 102 that is continuous with the print substance dispensing nozzle 110 and push the printing substance dispensing container 102 toward the front wall 116 of the valve body 108. As a result, the printing substance dispensing nozzle 110 that is connected to the printing substance dispensing container may rotated in a first direction within the valve body 108. Likewise, the user may pull the printing substance dispensing container 102 away from the front wall 116 of the valve body 108 causing rotation of the connected printing substance dispensing nozzle 110 in an opposite direction from the push. In an example, the printing substance dispensing nozzle 110 may be rotated within the valve body 108 approximately ninety degrees about the rotational axis within the cavity before the printing substance dispensing nozzle 110 encounters a portion of the front wall 116 of the valve body 108 impeding it from rotation any further in that direction.

Although some examples include the printing substance dispensing nozzle 110 rotatable within the valve body 108, other examples may include a dispensing nozzle 110 where fluid communication between the printing substance dispensing nozzle 110 and the print substance transfer window 122 is established other than through rotation of the printing substance dispensing nozzle 110 rotatable within the valve body 108. For example, fluid communication between the printing substance dispensing nozzle 110 and the print substance transfer window 122 may be established by sliding, actuating, opening, screwing, unscrewing, reorienting, etc. the printing substance dispensing nozzle 110 and/or a printing substance dispensing nozzle blocking, redirecting, and/or conduit structure.

The external surface of the front wall 128 the print substance dispensing nozzle 110 may be recessed. For example, the external surface of the front wall 128 may be recessed with respect to the orifice 126 and/or an orifice wall 130 that encompasses and/or defines the orifice 126. The orifice wall 130 may be in contact with the internal face 120 of the valve body 108. As such, a gap may exist surrounding the orifice wall 130 between the external surface of the front wall 128 the printing substance dispensing nozzle 110 and the internal face 120 of the valve body 108. A portion of the gap encompassing the orifice wall 130 may be occupied by a dispensing-side gasket material 132.

The dispensing-side gasket material 132 may be a flexible, pliable, and/or compressible material. The dispensing-side gasket material 132 may be an absorbent material. The dispensing-side gasket material 132 may be a material that will accommodate the embedding of a printing material in its surface. For example, the dispensing-side gasket material 132 may be made up of a felt material, a foam material, a solid or porous rubber material, etc. and/or combinations thereof.

The dispensing-side gasket material 132 may be fixed to the external surface of the front wall 128 of the printing substance dispensing nozzle 110. For example, the dispensing-side gasket material 132 may be adhered to the front wall 128 of the printing substance dispensing nozzle 110 with an adhesive compound. In some examples, the dispensing-side gasket material 132 may be fastened to the front wall 128 of the printing substance dispensing nozzle 110 by a mechanical mating method such as screws, clips, and/or other fasteners. As such, the dispensing-side gasket material 132 may rotate within the valve body 108 along with the rotation of the printing substance dispensing nozzle 110 within the valve body 108.

The dispensing-side gasket material 132 may fill the gaps created by the recessed front wall 128 of the printing substance dispensing nozzle 110. For example, the dispensing-side gasket material 132 may span the recess between the front wall 128 of the printing substance dispensing nozzle 110 and the internal face 120 of the valve body 108. The dispensing-side gasket material 132 may contact the internal face 120 of the valve body 108. As such, the dispensing-side gasket material 132 may slide against the internal face 120 of the valve body 108 as the printing substance dispensing nozzle 110 is rotated within the valve body 108.

The dispensing-side gasket material 132 may form a seal around the orifice wall 130. For example, the orifice 126 may be blocked by the internal face 120 of the valve body 108 when the print substance dispensing nozzle 110 is situated within the valve body 108 in the sealed position illustrated in FIG. 1. The orifice wall 130 may contact the internal face 120 of the valve body 108 creating a seal around the orifice 126. However, the orifice wall 130 may be made up of a material, such as a thermoplastic polymer, that is relatively more rigid than the dispensing-side gasket material 132. As such, the orifice wall 130 may be unable to deform and/or conform to the internal face 120 of the valve body 108 to create an air-tight seal around the orifice 126.

However, the dispensing-side gasket material 132 may surround the orifice wall 130 and conform to the space between the internal face 120 of the valve body 108 and the external surface of the front wall 128 of the printing substance dispensing nozzle 110. As such, the dispensing-side gasket material 132 may form a substantially air-tight seal around the orifice 126 when the orifice 126 is facing the internal face 120 of the valve body 108. The dispensing-side gasket material 132 may, therefore, prevent the leaking of a printing substance from the orifice 126 of the print substance dispensing nozzle 110 when in the sealed configuration. Additionally, dispensing-side gasket material 132 may prevent the introduction of environmental contaminants to the printing substance through the printing substance dispensing nozzle 110 when in the sealed configuration.

As described above, the dispensing-side gasket material 132 may be fixed to an external surface of the front wall 128 of the printing substance dispensing nozzle 110. Accordingly, the dispensing-side gasket material 132 may be rotatable along with printing substance dispensing nozzle 110. During rotation within the cavity of the valve body 108, the dispensing-side gasket material 132 may not only operate as a seal but may also operate as a wiping or cleaning mechanism. For example, the dispensing-side gasket material 132 may sweep excess printing substance that has escaped the orifice 126 and/or been deposited along the internal face 120 of the valve body 108, off the internal face 120 of the valve body 108. In some examples, the dispensing-side gasket material 132 may absorb or otherwise collect excess printing substance that has escaped the orifice 126 and/or has been deposited along the internal face 120 of the valve body 108.

As described above, the internal face 120 of the valve body 108 and the external surface of the front wall 128 may have complementary curved geometries. The dispensing-side gasket material 132 fixed to the external surface of the front wall 128 may conform to the shape of the external surface of the front wall 128. As such, the dispensing-side gasket material 132 may have a curved geometry that is complementary to the curved geometry of the internal face 120 of the valve body 108.

Therefore, the dispensing-side gasket material 132 may maintain contact with the internal face 120 of the valve body 108 during rotation of the printing substance dispensing nozzle 110. Likewise, the complementary geometries of the internal face 120 of the valve body 108 and the external surface of the front wall 128 may maintain contact between the internal face 120 of the valve body 108 and the orifice wall 130 during rotation of the printing substance dispensing nozzle 110.

The dispensing-side gasket material 132 may be exposed through the printing substance transfer aperture 122. That is, a portion of the dispensing-side gasket material 132 may occupy and/or protrude through a portion of the printing substance transfer aperture 122. For example, in the closed position illustrated in FIG. 1, a portion of the dispensing-side gasket material 132 is illustrated within the printing substance transfer aperture 122. As described above, the dispensing-side gasket material 132 may be slide-able against the internal face 120 of the valve body 190. Additionally, the dispensing-side gasket material 132 may be slide-able through the printing substance transfer aperture 122 as the printing substance dispensing nozzle 110 is moved between a first position, such as the closed position where the orifice 126 of the printing substance dispensing nozzle 110 is facing an internal face 120 of the valve body 108, and a second position, such as an open position where the orifice 126 of the printing substance dispensing nozzle 110 is facing through the printing substance transfer aperture 122. As such, the dispensing-side gasket material 132 may be exposed to an environment outside of the valve body 108.

Instead of continuing the curvature of the internal face 120 of the valve body 108 to the internal face of a sidewall 112, the internal face of the sidewall may be substantially planar and/or flat. The substantially planar, flat, and perpendicular sidewalls of the valve body 108 may be manufactured for a lower cost than continuing the curvature of the internal face 120 of the valve body 108. But more than that, confining the curvature to the internal face 120 of the valve body 108 may confine the points of contact to be maintained in order to preserve the seal to a single confined internal surface of the valve body 108.

As described above, the device 100 and the components thereof may be configured to operate as a dispensing-side mating interface 101. The dispensing-side mating interface 101 may be utilized to mate the printing substance dispensing container 102 with a receiving-side mating interface of a print substance receiving container.

For example, the device 100 may include an inlet port door engaging member 134. The engagement between the inlet port door engaging member 134 and the receiving-side mating interface will be discussed in greater detail with references to the figures below. The inlet port door engaging member 134 may include an extension from the external face 118 of the front wall 116 of the valve body 108. The inlet port door engaging member 134 may include an overhang or recess 136 between a bottom surface of the inlet port door engaging member 134 and a surface of the valve body 108 that is coplanar with the printing substance transfer aperture 122. The recess 136 may extend from a leading surface of the inlet port door engaging member 134 to a portion of the external face 118 of the front wall 116 of the valve body 108 immediately adjacent to the print substance transfer window 122.

The device 100 may also include a hood 138. The hood 138 may be fixed to the valve body 108. For example, the hood 138 may be permanent attached to the valve body 108 such as by fasteners, by adhesives, and/or by being molded as a unitary piece with the valve body 108. The hood 138 may extend below the valve body 108 and/or below the plane of the printing substance transfer aperture 122.

The hood 138 may include a plurality of walls that form a cavity 139. For example, the hood 138 may include a first wall 140. The first wall 140 may be a wall that is opposing a bottom external face 137 of the valve body 108. The first wall 140 may be angled such that the height of the cavity 139 is greater at one end of the first wall 140 than it is at another. The geometry of the first wall 140 may be varied. The geometry of the first wall may include curves, angles, bends, turns, and/or a plurality of planes.

The hood 138 may include a plurality of sidewalls, such as sidewall 141. The sidewalls may span from the first wall 140 to the valve body 108. For examples, the sidewalls may include walls that span from the valve body 108 to the first wall 140 in a plane that is substantially perpendicular to a plane of the bottom external face 137 of the valve body 108. The plurality of sidewalls may extend in planes that are substantially perpendicular to one another. However, the geometry of the sidewalls may be varied. The geometry of the sidewalls may include curves, angles, bends, turns, and/or a plurality of planes.

The combination of the bottom external face 137 of the valve body 108, the sidewalls, and the first wall 140 may define the cavity 139. That is, the perimeter walls of the cavity 139 may be the bottom external face 137 of the valve body 108, the sidewalls, and/or the first wall 140 of the hood 138. In some examples, the hood 138 may include an opening or mouth into the cavity 139. For example, the cavity 138 may be substantially enclosed except for an opening or a mouth outlined by a terminus of the sidewalls and the first wall 140 of the hood 139. The mouth or opening may provide an entrance into an otherwise sealed hood 138.

The hood 138 may encompass and/or shelter the printing substance transfer aperture 122. For example, the printing substance transfer aperture 122 may be encompassed within the cavity 139 and set back from the mouth or opening of the cavity 139. That is, the walls of the hood 138 may form a structure around the printing substance transfer aperture 122. For example, the first wall 140 and sidewalls of the hood 138 may serve as an enclosure around the printing substance transfer aperture 122. The first wall 140 and/or the sidewalls of the hood 138 may extend from the rear of the valve body 108, toward the inlet port door engaging member 134, to a point that covers the printing substance transfer aperture 122 and blocks a straight-line approach to the printing substance transfer aperture 122 from directly beneath it. Instead, to make contact with and/or interface with the printing substance transfer aperture 122 an object may enter from the side of the hood 138 through the opening or mouth and up to the printing substance transfer aperture 122.

The walls of the hood 138 and/or the bottom external face 137 of the valve body 108 may define the geometry of the cavity 139. That is, the various facets, angles, curves, bends, planes, etc. of the first wall 140 of the hood 138, the sidewalls of the hood 138, and/or the bottom external face 137 of the valve body 108 may define the corresponding geometric features of the cavity 139. As such, the walls of the hood 138 and/or the bottom external face 137 of the valve body 108 may define the geometry of an object that may be received within the cavity 139. Since the printing substance transfer aperture 122 is encompassed within the cavity 139, the walls of the hood 138 and/or the bottom external face 137 of the valve body 108 may define the geometry of an object that may be inserted within the cavity 139 to interface with and/or contact materials (e.g., orifice 126, dispensing-side gasket material 132, etc.) that may be presented within the printing substance transfer aperture 122 depending on a position of the printing substance dispensing nozzle 110 relative to the printing substance transfer aperture 122.

As such, the walls of the hood 138 and/or the bottom external face 137 of the valve body 108 may act as a mechanical keying interface to restrict the insertion of objects into the cavity 139 to objects that have a complementary geometry to the various facets, angles, curves, bends, planes. etc. of the first wall 140 of the hood 138, the sidewalls of the hood 138, and/or the bottom external face 137 of the valve body 108. That is, the walls of the hood 138 and/or the bottom external face 137 of the valve body 108 may act as a mechanical keying interface to restrict insertion of objects into the cavity 139 to objects such as a receiving-side interface that precisely fits within the cavity 139.

The above described mechanical keying interface may operate to provide stability during contact between the dispensing-side mating interface 101 and objects such as a receiving-side interface, having the appropriate complementary geometry, inserted into the cavity 139. For example, the complementary geometries between the receiving-side interface and the walls of the hood 138 and/or the bottom external face 137 of the valve body 108 may ensure a proper engagement between the various facets, angles, curves, bends, planes. etc. of the receiving-side interface and the various facets, angles, curves, bends, planes. etc. of first wall 140 of the hood 138, the sidewalls of the hood 138, and/or the bottom external face 137 of the valve body 108. A proper engagement may include establishing multiple points of contact between the receiving-side interface and the first wall 140 of the hood 138, the sidewalls of the hood 138, and/or the bottom external face 137 of the valve body 108 at multiple surfaces and/or in multiple surface planes. The complex three-dimensional multi-faceted engagement between the receiving-side interface and the first wall 140 of the hood 138, the sidewalls of the hood 138, and/or the bottom external face 137 of the valve body 108 may stabilize contact between the dispensing-side mating interface 101 and the receiving-side mating interface to prevent accidental engagement, accidental disengagement, and/or the introduction of strain to various components of the dispensing-side mating interface 101 and the receiving-side mating interface introduced during dispensing by small misalignments between the dispensing-side mating interface 101 and the receiving-side mating interface. For example, by ensuring simultaneous engagement along opposing faces of a receiving-side mating interface, the hood 138 may stabilize the device 100 during mating and operation.

In addition to blocking contact between the dispensing-side gasket material 132 and/or other contents of the cavity 139 and providing stability in permitted contact, the mechanical keying mechanism provided by the hood 138 and/or the bottom external face 137 of the valve body 108 may restrict actuation of functionality of the dispensing-side mating interface 101 to instances when an object such as a receiving-side interface that precisely fits within and/or properly engages the cavity 139. For example, the hood 138 and/or the bottom external face 137 of the valve body 108 may define the geometry of an object, such as a receiving-side mating interface, that may actuate a positional locking mechanism of device 100 that operates to lock the printing substance dispensing nozzle 110 into various positions during various stages of engagement between the dispensing-side mating interface 101 and the receiving-side mating interface.

For example, as describe above the printing substance dispensing nozzle 110 may be movable within the valve body 108. In some examples, the movement may be accomplished via rotation of the substance dispensing nozzle 110 about a rotational axis, although examples are not so limited. The printing substance dispensing nozzle 110 may be movable within the valve body 108 between a plurality of positions. That is, the printing substance dispensing nozzle 110 may be able to be rotated or otherwise moved into a variety of orientations with respect to the valve body 108 and/or with respect to the printing substance transfer aperture 122.

For example, the printing substance dispensing nozzle 110 may be movable between a first position and a second position. The first position may be a sealed position and the second position may be a dispensing position.

A sealed position may include the position illustrated in FIG. 1. For example, a sealed position may include a position where the orifice 126 of the printing substance dispensing nozzle 110 is facing an internal face 120 of the valve body 108.

In contrast, the dispensing position may include a position where the orifice 126 of the print substance dispensing nozzle 110 is facing and/or aligned through the printing substance transfer aperture 122. In the dispensing position, a printing substance may be dispensed from the orifice 126 out of the valve body 108 through the printing substance transfer aperture 122. The dispensing-side gasket material 132 may be slide-able against the internal face 120 of the valve body 108 when rotating the print substance dispensing nozzle 110 between the dispensing position and the sealed position.

The device 100 may include a locking rod channel 144. The printing substance dispensing nozzle 110 may include a pair of parallel sidewalls having substantially planar and/or flat external surfaces. The nozzle channel 124 may extend in between the parallel side walls. The locking rod channel 144 may include a channel through the pair of external faces of the parallel sidewalls of the printing substance dispensing nozzle 110. The locking rod channel 144 may be a continuous channel spanning continuously through the body of the printing substance dispensing nozzle 110 from one external face of a sidewall to the opposing external face of the opposing sidewall. However, the locking rod channel 144 may remain separate from the nozzle channel 124. That is, the locking rod channel 144 may not intersect the nozzle channel 124.

The locking rod channel 144 may be dimensioned to accommodate a locking rod passing through the locking rod channel 144. The locking rod channel 144 may include a first portion 149 and a second portion 148. The first portion 149 of the locking rod channel 144 may include a portion of the locking rod channel 144 to engage a locking rod within the locking rod channel 144 to lock the printing substance dispensing nozzle 110 in the dispensing orientation. The first portion 149 of the locking rod channel 144 may be dimensioned to block side-to-side movement of the locking rod channel 144 relative to the locking rod when the locking rod is being moved up or down within the first portion 149 of the locking rod channel 144.

The second portion 148 of the locking rod channel 144 may include a portion of the locking rod channel 144 to allow the locking rod to disengage from the first portion 149 and to free the printing substance dispensing nozzle 110 to be rotated to the dispensing orientation. The second portion 148 of the locking rod channel 144 may be dimensioned to block up and down movement of a locking rod during a side-to-side movement of the locking rod channel 144 relative to the locking rod within the second portion 148 of the locking rod channel 144.

In addition to the locking rod channel 144, the device 100 may include a locking rod window 146. The locking rod window 146 may include a window into the cavity of the valve body 108 through each external face of the pair of external faces of the sidewalls of the valve body 108. The locking rod window 146 may accommodate the passage of a locking rod through the valve body 108 and into the locking rod channel 144.

The locking rod window 146 may be dimensioned to accommodate a movement of a locking rod within the locking rod window 146. For example, the locking rod window 146 may be dimensioned to accommodate a movement of a locking rod between a first locked position and a second unlocked position within the locking rod window 146. For example, the locking rod window 146 may accommodate an up-and-down movement of a locking rod within the locking rod window 146. The locking rod may be in a locked position when it is located in a bottom portion of the locking rod window 146. The locking rod may be in an unlocked position when it is located in an upper portion of the locking rod window 146.

The locking rod may keep the printing substance dispensing nozzle 110 locked in the sealed position until the dispensing-side mating interface 101 is fully engaged with a receiving-side mating interface. For example, the locking rod may keep the printing substance dispensing nozzle 110 locked in the sealed position until the dispensing-side mating interface 101 has been slid into position over a receiving-side mating interface such that the printing substance transfer window aperture and/or the orifice 126 is aligned over the inlet port.

As such, the walls of the hood 138 and/or the bottom external face 137 of the valve body 108 acting as a mechanical keying interface may restrict actuation of the above described locking mechanism to instances where a receiving side mating interface with a complementary geometry to the cavity 139 is received within the cavity. That is, the geometry of the cavity 139 may define the geometry of a receiving-side mating interface able to be slid into the above described engagement involved in actuating the locking mechanism. For example, the hood 138 may restrict the geometry of the receiving-side mating interface able to be slid into position under a dispensing-side mating interface 101 such that the printing substance transfer window aperture 122 and/or the orifice 126 is aligned over the inlet port of the receiving-side mating interface. As such, the walls of the hood 138 and/or the bottom external face 137 of the valve body 108 acting as a mechanical keying interface restricting actuation of the locking mechanism, allowing a change in the position of the printing substance dispensing nozzle 110, to insertions of a receiving-side mating interface with a complementary geometry. For example, in order to move the printing substance dispensing nozzle 110 from a first sealed position to a second dispensing position in order to dispense a dispensable printing substance into the receiving-side mating interface, actuation of the locking mechanism accomplished by the full insertion of a receiving-side mating interface, with a complementary geometry to a geometry of the cavity, within the cavity may be involved.

Figure 2:
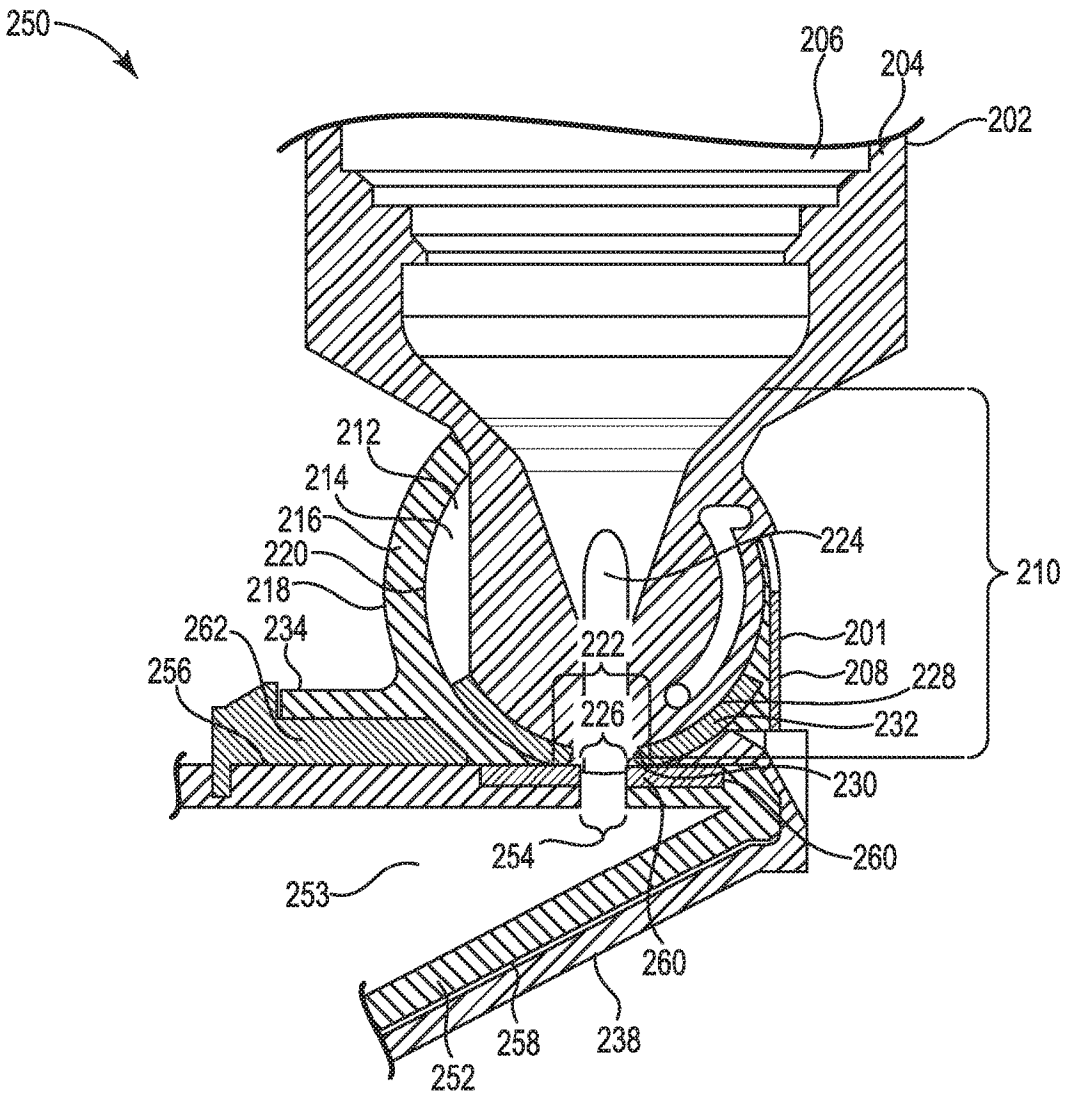
FIG. 2 illustrates a cross-sectional view of an example of a device with a dispensing aperture hood consistent with the disclosure.

FIG. 2 illustrates a cross-sectional view of an example of device 250 with a dispensing aperture hood consistent with the disclosure. The device 250 may include dispensing-side mating interface 201.

The dispensing-side mating interface 201 may include a valve body 208. The valve body 208 may include a pair of sidewalls, such as sidewall 212. The sidewalls may each include an internal face 214 that is substantially planar and/or flat. The valve body 208 may include a front wall 216 that spans between the sidewalls of the valve body 208. The front wall 216 may include an external face 218 and an internal face 220. The internal face 220 may be a curved face. The internal face 220 of the front wall 216 and the internal faces of the parallel sidewalls of the valve body 208 may define a cavity within the valve body 208.

A printing substance dispensing nozzle 210 may be fixed within the cavity of the valve body 208. That is, the print substance dispensing nozzle 210 may be attached to the valve body 208 such that the valve body prevents removal of the print substance dispensing nozzle 210 from the cavity of the valve body 208. While being fixed with respect to withdrawal from the cavity of the valve body 208, the print substance dispensing nozzle 210 may be movable within the valve body 208. For example, the print substance dispensing nozzle 210 may be rotatable within the valve body 208 about a rotational axis running through the center of the sidewalls of the valve body 208 and through the cavity of the valve body 208.

The printing substance dispensing nozzle 210 may include a nozzle channel 224. The nozzle channel 224 may be defined by an internal wall shaped to control the direction and/or characteristics of the flow of a printing substance from a printing substance dispensing container 202. The nozzle channel 224 and the internal walls of the print substance dispensing nozzle 210 may be contiguous with the channel 206 and/or the wall 204 of the printing substance dispensing container 202. The walls of the printing substance dispensing nozzle 210 may converge to an orifice 226. The orifice 226 may be encompassed and/or defined by an orifice wall 230. The orifice 226 in the printing substance dispensing nozzle 210 may be an opening through which a printing substance is dispensed from the channel 206 of the printing substance dispensing container 202.

The printing substance dispensing nozzle 210 may include a pair of parallel sidewalls with substantially planar and/or flat external surfaces. A front wall 228 of the printing substance dispensing nozzle 210, having a curved external surface, may span perpendicular to and in between the pair of parallel sidewalls of the printing substance dispensing nozzle 210. A dispensing-side gasket material 232 may be fixed to the curved external surface of the front wall 228 of the printing substance dispensing nozzle 210. The orifice wall 230 may protrude through and/or be surrounded by the dispensing-side gasket material 232.

The dispensing-side mating interface 201 may include a printing substance transfer aperture 222. The printing substance transfer aperture 222 may extend through the front wall 216 of the valve body 208. As described above, the printing substance dispensing nozzle 210 may be rotatable between a sealed position and a dispensing position within the valve body 208.

A dispensing position may include the position illustrated in FIG. 2. For example, a dispensing position may include a position where the orifice 226 of the printing substance dispensing nozzle 210 is facing through the printing substance transfer aperture 222. The orifice 226, the orifice wall 230, and/or a portion of the dispensing-side gasket material 232 may protrude through the printing substance transfer aperture 222. The printing substance dispensing nozzle 210 may dispense printing substance from the orifice 226 through the print substance transfer aperture 222 when the two are aligned.

The device 250 may include a receiving-side mating interface 252. The receiving-side mating interface 252 may include a first face 256 and a second face 258 opposing the first face 256. The receiving-side mating interface 252 may include additional faces operating as sidewall connectors between the first face 256 and the second face 258. For example, the receiving-side mating interface may include the third face 253 spanning between the first face 256 and the second face 258.

The receiving-side mating interface 252 may include a printing substance inlet port 254. The printing substance inlet port 254 may include a port through a first face 256 of the receiving-side mating interface 252. The printing substance inlet port 254 may be recessed with respect to the first face 256. The receiving-side mating interface 252 may include a receiving-side gasket material 260. The receiving-side gasket material 260 may encompass the printing substance inlet port 254 about its periphery.

The receiving-side mating interface 252 may be contiguous with a printing substance receiving container. The receiving container may include a container, such as a printing substance supply cartridge, of a printing device that may serve as a reservoir for the printing substance until a time when the printing substance is to be utilized by the printing device to perform a printing operation. The receiving-side mating interface 252 may be filled by receiving a printing substance from the printing substance dispensing nozzle 210 through the inlet port 254.

The receiving-side mating interface 252 may include an inlet port door 262. The inlet port door 262 may be slide-able along the first face 256. For example, the inlet port door 262 may be slide-able above the printing substance inlet port 254 to cover or uncover the printing substance inlet port 254. For example, the inlet port door 262 may be biased by a spring to close over the printing substance inlet port 254 and/or the receiving-side gasket material 260 encompassing the printing substance inlet port 254.

The inlet port door engaging member 234 of the dispensing-side mating interface 201 may engage the inlet port door 262. For example, the inlet port door engaging member 234 may engage the inlet port door 262 as the dispensing-side mating interface 201 is engaged with the receiving side mating interface 252. As the dispensing-side mating interface 201 is moved over the receiving side mating interface 252 the print substance transfer aperture 222 may be aligned over the printing substance inlet port 254. Further, the inlet port door engaging member 234 may push the inlet port door 262 away from the printing substance inlet port 254 and/or the receiving-side gasket material 260 encompassing the printing substance inlet port 254. Pushing inlet port door away may expose the printing substance inlet port 254 and/or the receiving-side gasket material 260 encompassing the printing substance inlet port 254.

The receiving-side gasket material 260 may be a flexible, pliable, and/or compressible material. For example, the receiving-side gasket material 260 may be an absorbent material. The receiving-side gasket material 260 may be a material that will accommodate the embedding of a printing material in its surface. For example, the receiving-side gasket material 260 may be made up of a felt material, a closed-cell foam material, a solid rubber material, etc. and/or combinations thereof.

When the device 250 is in a dispensing position, the dispensing-side gasket material 232 may protrude through the printing substance transfer aperture 222 and contact the receiving-side gasket material 260. The dispensing-side gasket material 232 and the receiving-side gasket material 260 may contact one another. The contact may form a seal around the orifice 226 and/or the printing substance inlet port 254.

Further, when the printing substance dispensing nozzle 210 is moved between the dispensing position and the sealed position, the dispensing-side gasket material 232 may wipe against the receiving-side gasket material 260. As such, excess printing substance and/or environmental contaminants may be swept away, embedded, absorbed, etc. by the surface of the dispensing-side gasket material 232 and/or the receiving-side gasket material 260 during the rotation of the print substance dispensing nozzle 210 within the cavity of the valve body 208.

As described above, the dispensing-side mating interface 201 may include the hood 238. The walls of the hood 238 may engage with and/or contact the first face 256, the second face 258, and/or sidewall faces between the first face 256 and the second face 258 such as the third face 253. Since engagement between the dispensing-side mating interface 201 and the receiving-side mating interface 252 involves engagement and/or contact between the walls of the hood 238, the walls of the hood 238 may serve as a protective sheltering mechanism for the printing substance transfer aperture 222, an engagement stabilizing mechanism, and/or a mechanical keying mechanism, as described above. For example, the hood 238 may accept insertion within its bounds of a receiving-side mating interface 252 that has a complementary geometry. Accordingly, an incorrect or incompatible receiving-side mating interface or another object may be prevented from being inserted by the hood 238. As such, damage to the dispensing-side mating interface 201, such as to the dispensing-side gasket material 232 occupying and/or protruding through the printing substance transfer window 222 may be prevented by the shelter offered by the hood 238. Additionally, actuation of the locking mechanism of the dispensing-side mating interface 201 may be prevented unless and/or until there is a receiving-side mating interface 252 docked fully within the hood 238. Furthermore, when the dispensing-side mating interface 201 is engaged with the receiving-side mating interface 252 having the appropriate complementary geometry, the engagement between multiple faces of the hood 238 and multiple faces of the receiving-side mating interface 252 may serve to add stability and lock the dispensing-side mating interface 201 and the receiving-side mating interface 252 in a stable engagement during transfer of a printing substance material between the two.

Figure 3:
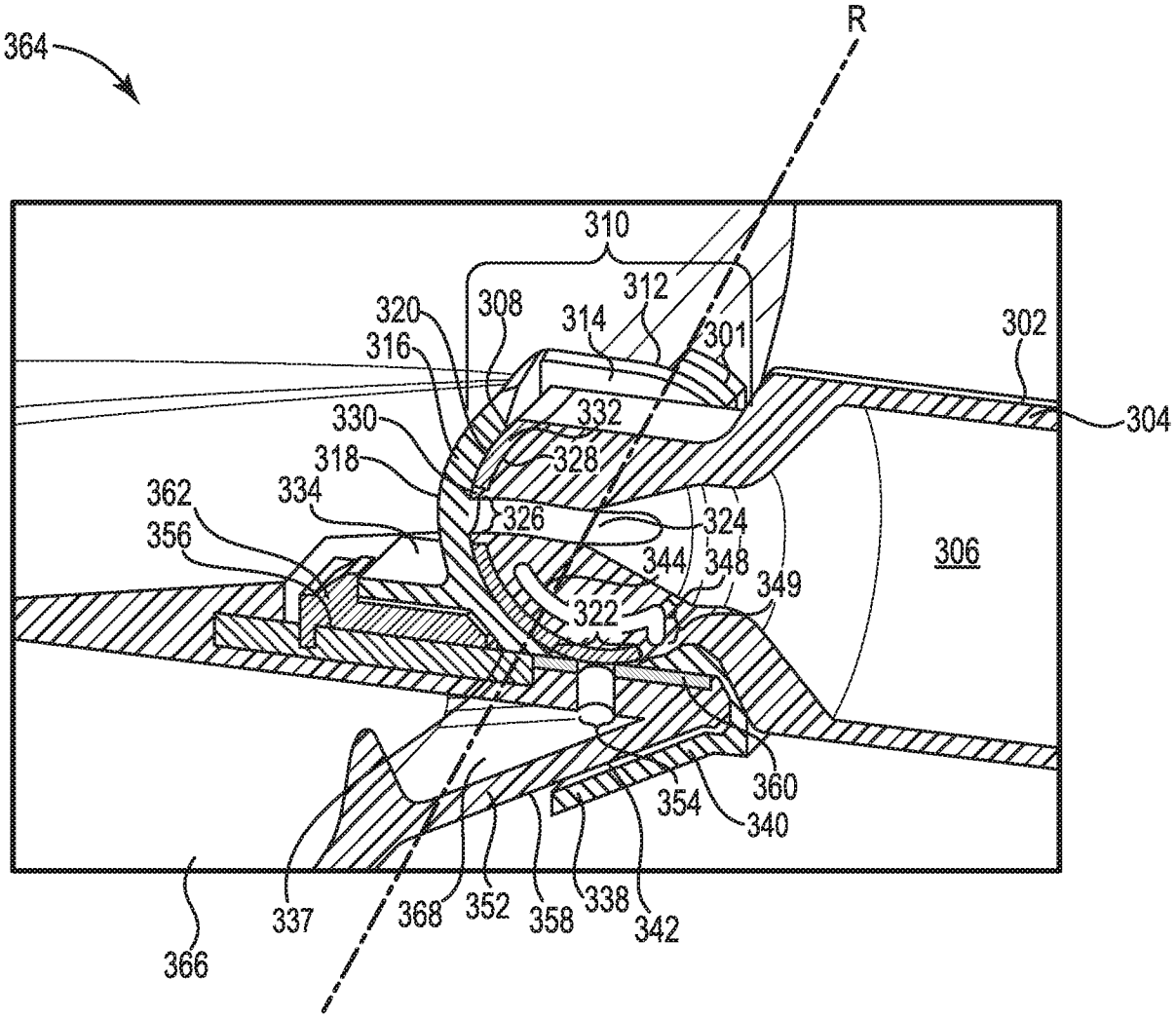
FIG. 3 illustrates a cross-sectional view of an example of a mating system with a dispensing aperture hood consistent with the disclosure.

FIG. 3 illustrates a cross-sectional view of an example of a mating system 364 with a dispensing aperture hood consistent with the disclosure. The system 364 may include dispensing-side mating interface 301 configured to be mated to a receiving-side mating interface 352.

The dispensing-side mating interface 301 may be an interface of a printing substance dispensing container 302. For example, the print substance dispensing container 302 may include a dispensing-side mating interface 301 portion. The dispensing-side mating interface 301 may be configured to be mated to a receiving-side mating interface 352.

For example, the dispensing-side mating interface 301 may include a hood 338. The hood 338 may include a plurality of walls that form a cavity (occupied by the receiving-side mating interface 352, as illustrated. For example, the hood 338 may include a first wall 340. The first wall 340 may be a wall that is opposing a bottom external face 337 of the valve body 308. The hood 338 may include a plurality of sidewalls that may span from the first wall 340 to the valve body 308 such that they encompass a cavity between the external face 337 of the valve body 308 and the first wall 340. The printing substance transfer window 322 may be inset into the cavity with respect to a mouth, spanning between the external face 337 of the valve body 308, the first wall 340, and/or the plurality of sidewalls, into the cavity. The geometric characteristics of the hood 338, and therefore the cavity, may be complementary to the geometric characteristics of the receiving-side mating interface 352. As such, the hood 338 may limit insertion of objects into the cavity to objects that have the geometric characteristics of the receiving-side mating interface 352. That is, in order to insert within the cavity and make contact with the plurality of walls forming the hood 338, an object may have to conform to the geometric characteristics of a particular compatible receiving-side mating interface 352.

The dispensing-side mating interface 301 may keep the print substance sealed within the dispensing-side mating interface 301/printing substance dispensing container 302. The dispensing-side mating interface 301 may engage with the receiving-side mating interface 352. The dispensing-side mating interface 301 may open the printing substance receiving container 366 to receive print substance through the receiving-side mating interface 352 during the engagement. The dispensing-side mating interface 301 may reseal the print substance within the dispensing-side mating interface 301/printing substance dispensing container 302 when the dispensing-side mating interface 301 is disengaged from the receiving-side mating interface 352.

The printing substance dispensing container 302 may include a wall 304 encompassing and/or defining a channel 306. In some examples, the printing substance dispensing container 302 may include a cylindrical channel 306. In some examples, the printing substance dispensing container 302 may be a reciprocating pump. For example, the printing substance dispensing container 302 may be utilized as a portion of a syringe mechanism for printing substance delivery.

The channel 306 of the printing substance dispensing container 302 may be contiguous with a nozzle channel 324 of a printing substance dispensing nozzle 310. For example, the channel 306 may taper from a first diameter to a second diameter, where the second diameter is a diameter of the nozzle channel 324 of the printing substance dispensing nozzle 310. The second diameter may be smaller than the first diameter.

The printing substance dispensing nozzle 310 may be contiguous with printing substance dispensing container 302. The printing substance dispensing nozzle 310 may be utilized to dispense printing substance from the printing substance dispensing container 302 into a printing substance receiving container 366. The printing substance dispensing nozzle 310 may direct the flow of a printing substance from the channel 306 of the printing substance dispensing container 302 through the nozzle channel 324 of the of the printing substance dispensing nozzle 310 and out the orifice 326 at an end of the nozzle channel 324.

The printing substance dispensing nozzle 310 may include a plurality of walls encompassing and/or defining the nozzle channel 324 and/or the orifice 326. For example, the printing substance dispensing nozzle 310 may include a pair of parallel sidewalls. The external faces of the pair of parallel sidewalls may run parallel to a longitudinal length of the nozzle channel 324. Each of the parallel sidewalls may include a substantially planar and/or flat external surface facing away from the nozzle channel 324. Additionally, each of the parallel sidewalls may include a cylindrical protrusion from an approximate center of its external surface.

In addition to the sidewalls, the printing substance dispensing nozzle 310 may include a font wall 328. The front wall 328 may include a curved external surface spanning between the sidewalls and encompassing and/or defining the orifice 326. That is, the orifice 326 may be an opening into the nozzle channel 324 through the front wall 328. The curved external surface of the front wall 328 of the printing substance dispensing nozzle 310 may be recessed with respect to the orifice 326. For example, an orifice wall 330 defining the orifice 326 may protrude outward perpendicular to the curved external surface of the front wall 328.

A dispensing-side gasket material 332 may be fixed to the curved external surface of the front wall 328. The dispensing-side gasket material 332 may span from the curved external surface of the front wall 328 to a terminus of the orifice wall 330 such that the plane of the external face of the dispensing-side gasket material 332 is substantially coplanar with plane of the orifice 326. That is, the dispensing-side gasket material 332 may entirely occupy the recess between the curved external surface of the front wall 328 and the orifice 326.

The dispensing-side mating interface 301 may include a valve body 308. The valve body 308 may include a plurality of walls defining a cavity. The print substance dispensing nozzle 310 may be contained within the cavity of the valve body 308. For example, the valve body 308 may include a pair of substantially parallel sidewalls, such as sidewall 312, separated from one another by a cavity. Each of the sidewalls may include an external surface and an internal surface, such as internal surface 314 of sidewall 312. The internal surface 314 of sidewall 312 of the valve body 308 may be a substantially planar and/or flat surface facing into the cavity of the valve body 308. The internal surface 314 of sidewall 312 of the valve body 308 may face toward and/or interface with the substantially planar and/or flat surface of the sidewall of the printing substance dispensing nozzle 310.

The valve body 308 may include a front wall 316 spanning between the sidewalls and about the periphery of the cavity of the valve body 308. The front wall 316 may include an external face 318 facing away from the cavity of the valve body 308. The front wall 316 may include an internal face 320 facing toward the cavity of the valve body 308. The internal face 320 may be a curved face to interface with the orifice 326, the orifice wall 330, and/or the dispensing-side gasket material 332.

The valve body 308 may include a printing substance transfer aperture 322. The printing substance transfer aperture 322 may include a window through the front wall 316 of the valve body 308. Printing substance may be transferred through the printing substance transfer aperture 322 to a receiving container 366. The printing substance transfer aperture 322 may be set back from a mouth or entrance into a cavity or shelter formed by the hood 338. As such, the printing substance may be transferred through the printing substance transfer aperture 322 to a receiving container 366 that has a complementary geometry to the cavity and is inserted fully within the cavity.

For example, the printing substance dispensing nozzle 310 may be located within the cavity of the valve body 308. The printing substance dispensing nozzle 310 may be trapped within the cavity of the valve body 308, such as by a male-female connection between the valve body 308 and the printing substance dispensing nozzle 310. However, the printing substance dispensing nozzle 310 may be movable to different positions about the valve body 308. In a non-limiting example, the dispensing nozzle may be rotatable within the valve body 308 about a rotational axis R.

The printing substance dispensing nozzle 310 may be movable about the valve body 308 between a first position and a second position. For example, the printing substance dispensing nozzle may be movable between a first sealed position, with an orifice 326 of the printing substance dispensing nozzle 310 facing an internal face 320 of the valve body 308, and a second dispensing position, with the orifice 326 of the printing substance dispensing nozzle 310 facing out of the printing substance transfer aperture 322.

The printing substance dispensing nozzle 310 may also include a locking rod channel 344. The locking rod channel 344 may include a channel through the printing substance dispensing nozzle 310 from one sidewall to another. The locking rod channel 344 may be dimensioned to accommodate a locking rod passing through the locking rod channel 344.

The locking rod channel 344 may include a first portion 349 and a second portion 348. The first portion 349 of the locking rod channel 344 may include a portion of the locking rod channel 344 to engage a locking rod traveling through the channel to lock the printing substance dispensing nozzle 310 in a dispensing orientation. The first portion 349 of the locking rod channel 344 may be dimensioned to block sideways movement of the locking rod channel 344 relative to the locking rod when the locking rod is being moved up or down within the first portion 349 of the locking rod channel 344.

The second portion 348 of the locking rod channel 344 may include a portion of the locking rod channel 344 to allow the locking rod to disengage from the first portion 349 and to free the printing substance dispensing nozzle 310 to be rotated to a dispensing. The second portion 348 of the locking rod channel 344 may be dimensioned to block up and down movement of a locking rod during sideways movement of the locking rod channel 344 relative to the locking rod within the second portion 348 of the locking rod channel 344.

As described above, the dispensing-side gasket material 332 may be attached to the curved external surface of the front wall 328 of the print substance dispensing nozzle 310. As such, the dispensing-side gasket material 332 may be slidable against the internal face 320 of the valve body 308 when rotating the printing substance dispensing nozzle 310 within the valve body 308 between a sealed position and a dispensing position. The dispensing-side gasket material 332 may form a seal around the orifice 326 between the curved external surface of the front wall 328 of the print substance dispensing nozzle 310 and the curved internal wall 320 of the front wall 316 of the valve body 308. The seal may keep the print substance sealed within the channel 324 of the print substance dispensing nozzle 310 and/or may wipe print substance and environmental contaminants from the curved internal wall 320 of the front wall 316 of the valve body 308.

The mating system 364 may include a receiving container 366. The receiving container 366 may be a printing substance cartridge. The receiving container 366 may be a reservoir that stores the printing substance and/or supplies the print substance directly to the printing mechanism of a printing device during execution of a printing operation by the printing device. For example, the printing substance receiving container 366 may supply the printing substance directly to a development system (e.g., printhead, print producing mechanism, etc.) and/or development area of a printing device.

The printing substance receiving container 366 may include a receiving-side mating interface 352. The receiving-side mating interface 352 may configured to be mated to a dispensing-side mating interface 301. The receiving-side mating interface 352 may be an interface of a printing substance receiving container 366. The receiving-side mating interface 352 may keep the print substance sealed within the receiving-side mating interface 352/printing substance receiving container 366, engage with the dispensing-side mating interface 301, free the dispensing-side mating interface 301 to open to dispense printing substance into the receiving-side mating interface 352 during the engagement, and/or reseal the printing substance within the receiving-side mating interface 352/printing substance receiving container 366 when the dispensing-side mating interface 301 is disengaged from the receiving-side mating interface 352.

The receiving-side mating interface 352 may include a plurality of walls. The plurality of walls may form various geometries. In an example, the plurality of walls may form a ledge such as a three-dimensional triangular protrusion from the print substance receiving container 366. However, the angles of the plurality of the walls and/or the juts or protrusions formed thereby are not limited to any one particular example. Rather a plurality of geometries is contemplated that may be utilized to produce various complexities in the keying mechanism between the hood 338 and the receiving-side mating interface 352. The plurality of walls may define a cavity 368 within the receiving-side mating interface 352. Printing substance may be dispensed into and/or travel through the cavity 368 on its way into the printing substance receiving container 366.

A first external face 356 of the receiving-side mating interface 352 may face away from a cavity 368 of the receiving-side mating interface 352. The first external face 356 may be a face of the receiving-side mating interface 352 that faces toward the dispensing-side mating interface 301 during engagement between the dispensing-side mating interface 301 and the receiving-side mating interface 352. A portion of the first external face 356 may be recessed. The recessed portion may encompass and/or define a printing substance inlet port 354 into the cavity 368 of the receiving-side mating interface 352. The recessed portion may be occupied by a receiving-side gasket material 360. That is receiving-side gasket material 360 may fill in the recess and further encompass and/or define the printing substance inlet port 354.

A second external face 358 of the receiving-side mating interface 352 may oppose and/or run at a slant away from the first external face 356. The second external face 358 and the first external face 356 may form an angle and/or a geometry that is complementary to a cavity of the dispensing-side mating interface 301 formed within the hood 338.

The receiving-side mating interface 352 may fit within the cavity formed by the hood 338, simultaneously contacting, with its plurality of walls, an internal face 342 of the first wall 340 of the hood 338, the valve body 308, a plurality of sidewalls of the hood 338 and/or the dispensing-side gasket material 332 of the dispensing-side mating interface 301. When docked within the hood 338 an engagement between the dispensing-side mating interface 301 and the receiving-side mating interface 352 may be achieved that is stabilized against multiple planes of the receiving-side mating interface 352 and against multiple planes of the dispensing-side mating interface 301. Since the hood 338 has particular geometric characteristics it may limit the insertion of receiving-side mating interfaces to those with the geometric characteristics complementary to the hood 338 that achieve the aforementioned engagements.

In addition, an inlet port door 362 may be slide-able along the first external face 356 of the receiving-side mating interface 352. For example, the inlet port door 362 may be slide-able along the first external face 356 of the receiving-side mating interface 352 over the printing substance inlet port 354. The inlet port door 362 may be biased in a direction to remain situated over the printing substance inlet port 354.

The inlet port door 362 may maintain a seal over the printing substance inlet port 354 when positioned over it. When the dispensing-side mating interface 301 is brought into engagement with the receiving-side mating interface 352, an inlet port door engaging member 334 protruding from the external surface 318 of the front wall 316 of the valve body 308 may engage a raised portion of the inlet port door 362. The inlet port door engaging member 334 may push the inlet port door 362 away from the printing substance inlet port 354.

The dispensing-side gasket material 332 protruding through the printing substance transfer aperture 322 may contact and/or wipe against the surface of the receiving-side gasket material 332. This contact and/or wiping may wipe errant print substance or contaminants from the receiving-side gasket material 332 and maintain a seal over the printing substance inlet port 354 while the dispensing-side mating interface 301 is brought into engagement with the receiving-side mating interface 352 and/or the print substance dispensing nozzle 310 is in a sealed position.

The dispensing-side mating interface 301 may retain the printing substance sealed within the dispensing-side mating interface 301/printing substance dispensing container 302 until the dispensing-side mating interface 301 is fully engaged with the receiving-side mating interface 352. For example, the dispensing-side mating interface 301 may retain the printing substance sealed within the dispensing-side mating interface 301/printing substance dispensing container 302 until the printing substance transfer aperture 322 of the dispensing-side mating interface 301 is fully aligned above the printing substance inlet port 354 of the receiving-side mating interface 352.

For example, the dispensing-side mating interface 301 may be reconfigurable to lock and unlock the move-ability of the printing substance dispensing nozzle 310 based on the engagement of the dispensing-side mating interface 301 with the receiving-side mating interface 352. Prior to the dispensing-side mating interface 301 fully engaging with the receiving-side mating interface 352, the dispensing-side mating interface 301 may be in a first configuration. In the first configuration, the printing substance dispensing nozzle 310 may be locked out from movement out of a sealed position.

For example, a locking rod may remain engaged with the first portion 349 of the locking rod channel 344, locking the printing substance dispensing nozzle 310 in a sealed position, until the dispensing-side mating interface 301 is fully engaged with the receiving-side mating interface 352. The dispensing-side mating interface 301 may be fully engaged with the receiving-side mating interface 352 when the print substance transfer aperture 322 is aligned with the inlet port 354 and/or the plurality of walls of the receiving-side mating interface 352 are inserted within the cavity formed by the hood 338 and docked in multi-faceted contact with the plurality of walls of the hood 338. The geometry of at least one of the walls of the hood 338 may prevent the insertion of a receiving-side mating interface 352 into the hood 238 to the extent that it could achieve said alignment between the print substance transfer aperture 322 and the inlet port 354.

Further, once the dispensing-side mating interface 301 has fully engaged with the receiving-side mating interface 352 the configuration of the dispensing-side mating interface 301 may be altered to a second configuration. For example, engagement between the receiving-side mating interface 352 and the dispensing-side mating interface 301 may alter the configuration of the dispensing-side mating interface 301 to the second configuration. In the second configuration, the printing substance dispensing nozzle 310 may be unlocked to move to a dispensing position and dispense printing substance into the receiving-side mating interface 352.

For example, once the dispensing-side mating interface 301 is fully engaged within the hood 338 of the receiving-side mating interface 352 the locking rod may be lifted into the second portion 348 of the locking rod channel 344 allowing the printing substance dispensing nozzle 310 to be moved into the dispensing position. Once in the dispensing position, the orifice 326 of the printing substance dispensing nozzle 310 may be aligned to face through the printing substance transfer aperture 322. Then, the printing substance may pass from the printing substance dispensing container 302, through the nozzle channel 324 of the printing substance dispensing nozzle 310, out of the orifice 326 of the printing substance dispensing nozzle 310, through the printing substance transfer aperture 322, and into the receiving-side mating interface 352 through the printing substance inlet port 354 of the receiving-side mating interface 352.

Since the dispensing-side gasket material 332 may be fixed to and/or movable with the printing substance dispensing nozzle 310, the dispensing-side gasket material 332 may maintain contact with and wipe against the receiving-side gasket material 360 during movement between positions. This contact and wiping may keep both surfaces free from print substance and/or contaminants. Further, since the dispensing-side gasket material 332 surrounds the orifice 326, the receiving-side gasket material 360 surrounds the inlet port 354, and the two gasket materials may maintain contact through the print substance transfer aperture 322, a seal around the orifice 326-to-inlet port 354 connection may be maintained between the two by the contacting gasket materials.

Furthermore, once dispensing is finished, the printing substance dispensing nozzle 310 may be rotated back to a sealed position by virtue of the receiving-side mating interface 352 still being fully engage within the hood 338. Once in the sealed orientation, the dispensing-side mating interface 301 may be disengaged from the receiving-side mating interface 352. Disengaging the dispensing-side mating interface 301 from the receiving-side mating interface 352 may return the dispensing-side mating interface 301 to the first configuration. As such, the printing substance dispensing nozzle 310 may be relocked back into the sealed orientation.

Figure 4:
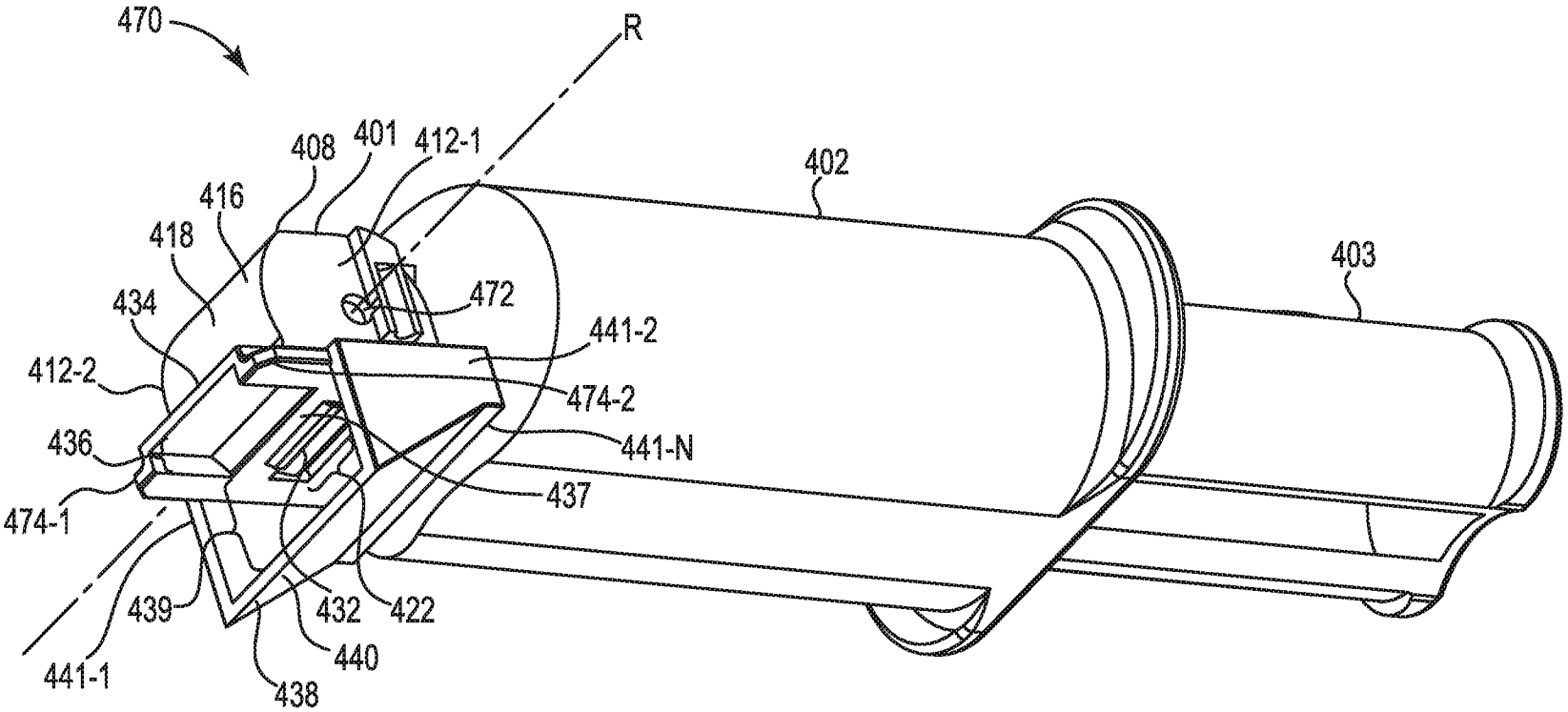
FIG. 4 illustrates an example of a device with a dispensing aperture hood consistent with the disclosure.

FIG. 4 illustrates an example of a device 470 with a dispensing aperture hood consistent 438 with the disclosure. The device 470 may include a dispensing-side mating interface 401. The device 470 may include a printing substance dispensing container 402. The printing substance dispensing container 402 may include a printing substance reservoir such as a hollow channel within a body. The printing substance dispensing container 402 may be configured to operate as a reciprocating pump. For example, the printing substance dispensing container 402 may include a piston 403 to travel within the channel of the dispensing container 402. The piston 403 may travel within the channel and may cause a printing substance to be expelled from an orifice of a printing substance dispensing nozzle 410 in fluid communication with the channel of the dispensing container 402.

The device 470 may include a printing substance dispensing nozzle. The printing substance dispensing nozzle may be fit within a cavity of a valve body 408. For example, the sidewall of the printing substance dispensing nozzle may include a protrusion from its center portion. The protrusion may engage within a complementary shaped recess and/or aperture 472 in a sidewall 412-1 . . . 412-2 of the valve body 408.

The protrusions from the sidewall of the printing substance dispensing nozzle may be rotatable within the window 472. Therefore, the printing substance dispensing nozzle may rotate within the valve body 408 about a rotational axis R. The rotational axis R may pass through the center of the protrusion and the center of the aperture 472. The printing substance dispensing nozzle and, therefore, the printing substance dispensing container 402 may be rotatable between a sealed position (illustrated in FIG. 4) and a dispensing position (illustrated, for example, in FIG. 2). In the dispensing position, the printing substance dispensing nozzle and/or the printing substance dispensing container 402 may be rotated about the rotational axis R to a position ninety-degrees apart from its position in the sealed position.

However, the examples described herein are not limited to those where the printing substance dispensing nozzle and/or the printing substance dispensing container 402 may be rotated about the rotational axis R. For example, other mechanisms are contemplated where the printing substance dispensing nozzle and/or the printing substance dispensing container 402 are movable between a sealed position and a dispensing position by other mechanisms. For example, printing substance dispensing nozzle and/or the printing substance dispensing container 402 may be slide-able, actuatable, openable, fasten or unfasten-able, reorientable, redirectable, block-able, and/or incorporate the use of a trap door or redirecting conduit to move between the sealed orientation and the dispensing orientation.

The device 470 may include an inlet port door engaging member 434. The inlet port door engaging member 434 may protrude from the external face 418 of the front wall 416 of the valve body 408. The inlet port door engaging member 434 may include a recess 436. The recess 436 may be formed under a ceiling wall and between two sidewalls of the port door engaging member 434. The inlet port door engaging member 434 may engage and move an inlet port door on a receiving-side mating interface of a printing substance receiving container. The recess 436 may house the inlet port door during its movement by the inlet port door engaging member 434.

The device 470 may include a pair of guide members 474-1 . . . 474-2. The guide members 474-1 . . . 474-N may include fins protruding perpendicularly from the sidewalls of the inlet port door engaging member 434. The guide members 474-1 . . . 474-N may be dimensioned to engage with and slide within a channel in a receiving-side mating interface of a print substance receiving container. For example, the guide members 474-1 . . . 474-N may slide within the channel in the receiving-side mating interface during mating in order to maintain an engagement between the dispensing-side mating interface 401 and a receiving side mating interface.

The device 470 may include a printing substance transfer aperture 422. The printing substance transfer aperture 422 may include an aperture through the wall of the valve body 408. The print substance transfer aperture 422 may include an opening spanning through the valve body 408. The print substance transfer aperture 422 may serve as a conduit for print substance transfer between the cavity of the valve body 408 and a print substance receiving container outside of the valve body 408. That is, the printing substance transfer aperture 422 may include an aperture through which a printing substance dispensing nozzle may dispense printing substance.

When the printing substance dispensing container 402 and/or the printing substance dispensing nozzle is in the sealed position, such as illustrated in FIG. 4, the dispensing-side gasket material 432 may be within and/or protruding through the printing substance transfer aperture 422. The dispensing-side gasket material 432 may be movable through the printing substance transfer aperture 422 as the printing substance dispensing container 402 and/or the printing substance dispensing nozzle is moved to the dispensing position, as illustrated in FIG. 2. As such, the dispensing-side gasket material 432 may be exposed to objects outside of the valve body 408.

However, the device 470 may include a hood 438. The hood 438 may be fixed to the valve body 408. The hood 438 may include a plurality of walls that encompass a cavity 439. The printing substance transfer aperture 422 and/or components present within the printing substance transfer aperture 422, such as the dispensing-side gasket material 432 may open into the cavity 439 and/or be recessed back from an opening into the cavity 439 such that the printing substance transfer aperture 422 is sheltered from the external environment by the hood 438.

The hood 438 may include a plurality of walls. For example, the hood may include a first wall 440. The first wall 440 may be a wall that is opposing a bottom external face 437 of the valve body 408. The geometry of the first wall 440 may be varied. The geometry of the first wall may include curves, angles, bends, turns, and/or a plurality of planes.

The hood 438 may include plurality of sidewalls 441-1 . . . 441-N. The sidewalls 441-1 . . . 441-N may span from the first wall 440 to the valve body 408. For examples, the sidewalls 441-1 . . . 441-N may include walls that span from the valve body 408 to the first wall 440 in a plane that is substantially perpendicular to a plane of the bottom external face 437 of the valve body 408. The plurality of sidewalls 441-1 . . . 441-N may extend in planes that are substantially perpendicular to one another. However, the geometry of the sidewalls 441-1 . . . 441-N may be varied. The geometry of the sidewalls 441-1 . . . 441-N may include curves, angles, bends, turns, and/or a plurality of planes.

The hood 438 may encompass and/or shelter the printing substance transfer aperture 422. For example, the printing substance transfer aperture 422 may be encompassed within the cavity 439 and set back from the mouth or opening of the cavity 439. That is, the walls of the hood 438 may form a structure around the printing substance transfer aperture 422. For example, the first wall 440 and sidewalls 441-1 . . . 441-N of the hood 138 may serve as an enclosure around the printing substance transfer aperture 422. The first wall 440 and/or the sidewalls 441-1 . . . 441-N of the hood 438 may extend from the rear of the valve body 108, toward the inlet port door engaging member 434, to a point that covers the printing substance transfer aperture 422 from below and blocks a straight-line approach to the printing substance transfer aperture 422 from directly beneath it. Instead, to make contact with and/or interface with the printing substance transfer aperture 422 an object may enter from the side of the hood 438 through the opening or mouth and up to the printing substance transfer aperture 422.

As such, the combination of the bottom external face 437 of the valve body 408, the sidewalls 441-1 . . . 441-N, and the first wall 440 may define the geometric characteristics of the cavity 439. That is, the various facets, angles, curves, bends, planes, etc. of the first wall 440 of the hood 438, the sidewalls 441-1 . . . 441-N of the hood 438, and/or the bottom external face 437 of the valve body 408 may define the corresponding geometric features of the cavity 439. As such, the walls of the hood 438 and/or the bottom external face 437 of the valve body 408 may define the geometry of an object that may be received within the cavity 139. As such, the walls of the hood 438 and/or the bottom external face 437 of the valve body 408 may act as a mechanical keying interface to restrict the insertion of objects into the cavity 439 to objects that have a complementary geometry to the various facets, angles, curves, bends, planes, etc. of the first wall 440 of the hood 438, the sidewalls 441-1 . . . 441-N of the hood 438, and/or the bottom external face 437 of the valve body 408. That is, the walls of the hood 438 and/or the bottom external face 437 of the valve body 408 may act as a mechanical keying interface to restrict insertion of objects into the cavity 439 to objects such as a receiving-side interface that is dimensioned to fit within the cavity 439 and/or engage in simultaneous multi-surface contact with the hood 438.

Figure 5:
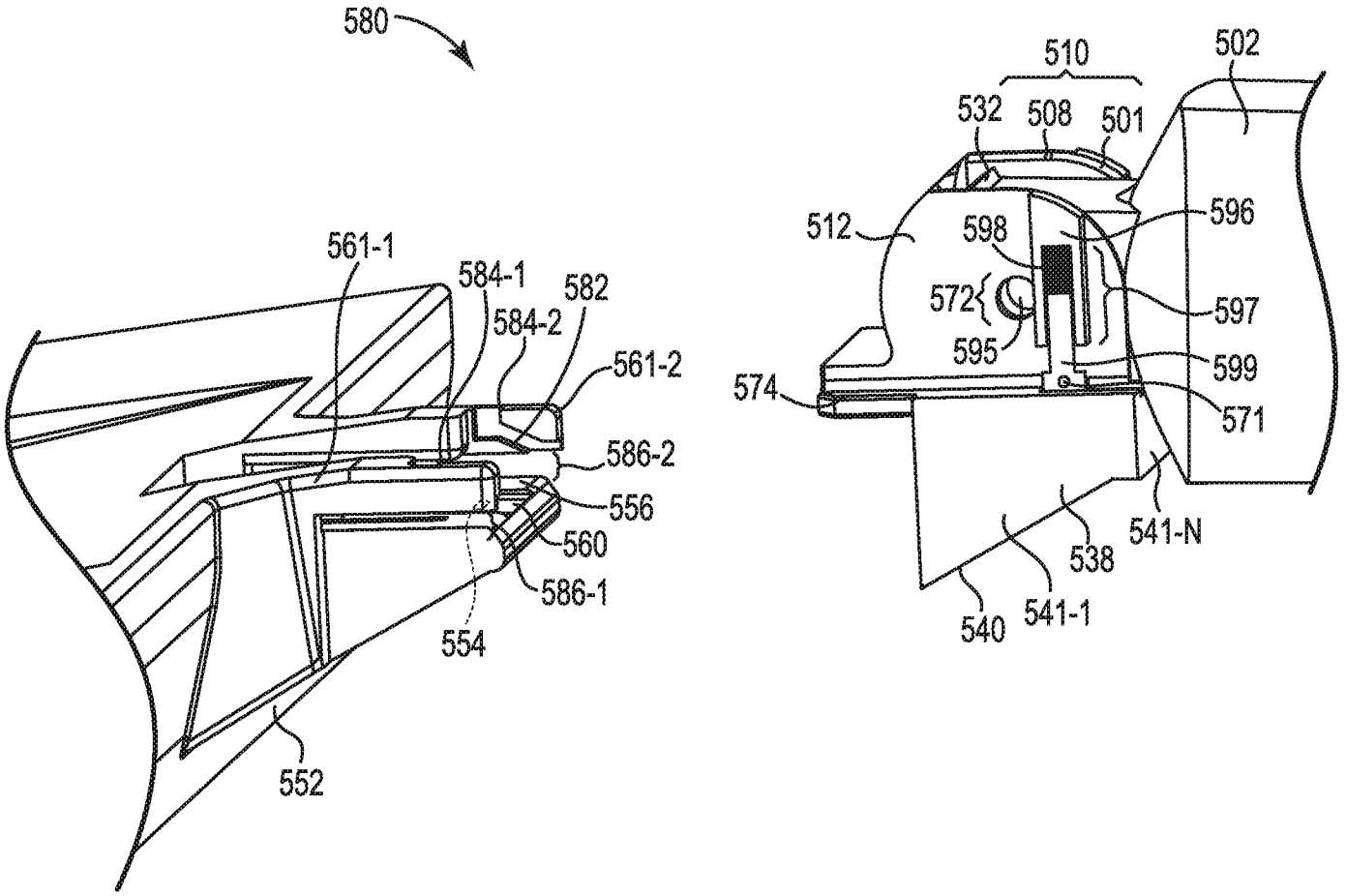
FIG. 5 illustrates a cross-sectional view of an example of a mating system with a dispensing aperture hood consistent with the disclosure.

FIG. 5 illustrates a cross-sectional view of an example of a mating system 580 for with a dispensing aperture hood 538 consistent with the disclosure. The system 580 may include dispensing-side mating interface 501 configured to be mated to a receiving-side mating interface 552.

The system 580 may include a printing substance dispensing nozzle 510 connected to a printing substance dispensing container 502. The dispensing-side mating interface 501 may include a valve body 508. The valve body 508 may include a plurality of walls. The plurality of walls may encompass and/or define a cavity inside of the valve body 508. A portion of the printing substance dispensing nozzle 510 may be located within the cavity of the valve body 508. The dispensing-side gasket material 532 may be fixed to the portion of the printing substance dispensing nozzle 510 within the cavity. A portion of the dispensing-side gasket material 532 may protrude through a printing substance transfer window through the valve body 508.

A portion of the printing substance dispensing nozzle 510 may be engaged with a complementary portion of the valve body 508. The engagement between the two may keep the portion of printing substance dispensing nozzle 510 within the valve body 508. For example, a cylindrical protrusion 595 from the face of a sidewall of the printing substance dispensing nozzle 510 within the valve body 508 may be engaged within and/or through an aperture 572 through a sidewall 512 of the valve body 508. The aperture 572 and/or the protrusion 595 may be dimensioned such that the protrusion 595 is rotatable within the window 572.

However, the engagement between the valve body 508 and the printing substance dispensing nozzle 510 is not limited to such a design. Various other mechanisms are contemplated. For example, cylindrical holes may be present in the face of a sidewall of the printing substance dispensing nozzle 510 within the valve body 508. In such examples, a retaining pin may pass through the aperture 572 and engage into the cylindrical holes. The retaining pin, in such examples, may be dimensioned such that it may be rotatable within the window 572.

Additionally, a locking pin housing 596 may protrude from the sidewall 512 of the valve body 508. The housing 596 may include a plurality of housing walls. The plurality of housing walls in combination with the sidewall 512 of the valve body 508 may encompass and/or define a cavity 597 within the locking pin housing 596.

The dispensing-side mating interface 501 may include a locking pin 599. The locking pin 599 may be movable within the cavity 597 of the locking pin housing 596. The locking pin 599 may travel within the cavity 597 of the locking pin housing 596 to seat the locking pin 599 at various depths within the locking pin housing 596.

The dispensing-side mating interface 501 may include a locking rod 571. The locking rod 571 may be engaged within the locking pin 599. For example, the locking rod 571 may be engaged through a portion of the locking pin 599. The locking rod 571 may travel through the locking pin 599, through a window in the sidewall 512 of the valve body 508, and through a locking rod channel in the print substance dispensing nozzle 510. The locking rod 571 may protrude outside of the locking pin 599. The portion of the locking rod 571 protruding outside of the locking pin 599 may be engageable by a ramp 582 on the receiving-side mating interface 552 during mating.

The window in the sidewall 512 of the valve body 508 may be located behind the locking pin 599 in the view illustrated in FIG. 5. The window in the sidewall 512 of the valve body 508 may be dimensioned such that the locking rod 571 may move up and down within the window. The locking pin 599 may move up and down with the locking rod 571. The up and down movement of the locking rod 571 may cause the locking pin 599 to travel further into and/or out of the cavity 597 of the locking pin housing 596. That is, force applied to the locking rod 571 may be translated to movement of the locking pin 599 into and/or out of the locking pin housing 596. For example, engagement between the locking rod 571 and a ramp 582 on the receiving-side mating interface 552 may drive the locking rod 571 upward during mating. The upward force applied to the locking rod 571 may translate to the locking pin 599, causing the locking pin 599 to recede further into the cavity 597 of the locking pin housing 596.

The dispensing-side mating interface 501 may include an urging member 598. The urging member 598 may include a spring. The urging member 598 may be contained within the cavity 597 of the locking pin housing 596. The urging member 598 may be compressible by the locking pin 599 as the locking pin 599 is pushed deeper into the locking pin housing 596. The urging member 598 may bias the locking pin 599 out of the cavity 597 of the locking pin housing 596. For example, the urging member 598 may bias the locking pin 599 against a guide member 574 of the dispensing-side mating device 501. As such, the guide member 574 may serve as a stop preventing the locking pin 599 from completely exiting the cavity 597 of the locking pin housing 596.

The biasing force of the urging member 598 exerted against the locking pin 599 may be translated to the locking rod 571 engaged with the locking pin 599. For example, the biasing force of the urging member 598 may bias the locking rod 571 downward in the window through the sidewall 512 of the valve body 508 and downward in the locking rod channel through the printing substance dispensing nozzle 510.

The dispensing-side mating interface 501 may include a hood 538. The hood 538 may include a plurality of walls such as first wall 540 and a plurality of sidewalls 541-1 . . . 541-N connecting the first wall 540 to the valve body 508. The walls of the hood 538 may encompass and define a cavity between the walls and the valve body 508. A printing substance transfer aperture through the valve body 508 may be position within the cavity such that the walls 540 and 541-1 . . . 541-N form a roof and walls sheltering the printing substance transfer aperture through the valve body 508.

The first wall 540 and the plurality of sidewalls 541-1 . . . 541-N may, along with an external face of the valve body 508, define the geometric characteristic of the cavity. As such, the first wall 540 and the plurality of sidewalls 541-1 . . . 541-N, along with an external face of the valve body 508, may define the geometry of the receiving-side mating interface 552 that is permitted to be inserted within the cavity. For example, the first wall 540 and the plurality of sidewalls 541-1 . . . 541-N may operate as a mechanical keying interface by defining the geometric characteristics that receiving-side mating interface 552 possess in order to slide fully within the cavity created by the first wall 540, the plurality of sidewalls 541-1 . . . 541-N and/or the external face of the valve body 508.

The receiving-side mating interface 552 may include a printing substance inlet port 554. The printing substance inlet port 554 may be coverable by an inlet port door (not illustrated in FIG. 5 for clarity purposes) biased, such as by a spring mechanism, to the closed position resting over the printing substance inlet port 554.

A receiving-side gasket material 560 may encompass the printing substance inlet port 554. For example, the receiving-side gasket material 560 may be fixed into a recess in the first face 556 of the receiving-side mating interface 552 around the printing substance inlet port 554.

The receiving-side mating interface 552 may include a plurality of arms 561-1 and 561-2. The arms 561-1 . . . 561-2 may include arms that that extend from the receiving side mating interface 552 and are elevated above the first face 556 of the receiving-side mating interface 552. The arms 561-1 . . . 561-2 may form a portion of a sidewall extending perpendicular to a plane of the first face 556 of the receiving-side mating interface 552. The arms 561-1 . . . 561-2 may be separated along a portion of their length from the first face 556 of the receiving-side mating interface 552 by a channel 586-1 . . . 586-2 or gap.

Each of the arms 561-1 . . . 561-2 may include a ramp, such as ramp 582. Each ramp 582 may include a sloped groove in the corresponding arm 561-2. The sloped groove may ascend from an opening proximate the first face 556 of the receiving-side mating interface 552 as it extends back along the length of the corresponding arm 561-2.

Each ramp 582 may be dimensioned to engage and/or lift a locking rod 571 in a dispensing-side mating interface 501. For example, as the dispensing-side mating interface 501 is mated to the receiving-side mating interface 552 the locking rod 571 of the dispensing-side mating interface 501 may be forced up the slope of the ramp 582.

Each ramp 582 may include a catch 584-1 . . . 584-2. The catch 584-1 . . . 584-2 may be located at or near a top portion of the ramp 582. The catch 584-1 . . . 584-2 may catch the locking rod 571 of the dispensing-side mating interface 501. For example, when the dispensing-side mating interface 501 is fully engaged with the receiving-side mating interface 552 and the printing substance dispensing nozzle 510 is freed to rotate to a dispensing position, the locking rod 571 may be engaged with the catch 584-1 . . . 584-2. When engaged with the catch 584-1 . . . 584-2 the locking rod 571 may be blocked from descending back down the ramp 582. For example, when the dispensing-side mating interface 501 is fully engaged with the receiving-side mating interface 552 and the printing substance dispensing nozzle 510 of the dispensing-side mating interface 501 has begun to move to a dispensing position, the locking rod 571 may be blocked from descending back down the ramp 582.

As described above, the receiving-side mating interface 552 may include a plurality of channels 586-1 . . . 586-2 between the first face 556 of the receiving-side mating interface 552 and the arms 561-1 . . . 561-2. The channels 586-1 . . . 586-2 may include a gap between the first face 556 of the receiving-side mating interface 552 and the arms 561-1 . . . 561-N overhanging a portion of the first face 556. The channels 586-1 . . . 586-N may be dimensioned to engage guide members, such as guide member 574, of the dispensing-side mating interface 501. For example, the guide members 574 may slide within the complementary channel 586 over the first face 556 of the receiving-side mating interface 552 and under a bottom face of the arms 561-1 . . . 561-2. The channel 586 may guide alignment and maintain engagement between the dispensing-side mating interface 501 and the receiving-side mating interface 552 during engagement therebetween.

As described above, the geometric characteristics of the hood 538 may define the geometric characteristics of the cavity formed by the hood 538 between the first wall 540 of the hood 538, the sidewalls 541-1 . . . 541-N of the hood 538, and/or the valve body 508. As such, the hood 538 may act as a mechanical keying mechanism that accommodates a receiving-side mating interface 552 having a complementary geometry to the hood 538 within the cavity between the first wall 540 of the hood 538, the sidewalls 541-1 . . . 541-N of the hood 538, and/or the valve body 508. As the receiving-side mating interface 552 is inserted into the hood the locking pin 599 may engage against a ramp 582 on the arms 561-1 . . . 561-2 of the receiving side mating interface 552. The ramp 582 may drive the locking pin 599 upward as the receiving-side mating interface 552 is inserted within the hood 538. The valve body 508 may include a locking rod aperture through each face of the pair of flat external faces of the valve body 508 and the locking rod aperture may be dimensioned to accommodate a movement of the locking rod 571 between a first locked position and a second unlocked position within the locking rod aperture. The upward movement of the locking pin 599 in the locking rod aperture may translate to a lifting of the locking rod 571 embedded in the locking pin 599. The locking rod 571 may initially be in a first portion of a locking rod channel in the pair of flat external faces of the printing substance dispensing nozzle 510. In the first portion of the locking rod channel, the locking rod 571 may lock the printing substance dispensing nozzle 510 in the first sealed position. However, the locking rod 571 may be lifted out of the first portion of a locking rod channel as the receiving-side mating interface 552 is inserted within the hood 538. That is, the movement of the locking rod 571 to the second unlocked position within the locking rod aperture may introduce the locking rod 571 in to a second portion of the locking rod channel in the pair of flat external faces of the printing substance dispensing nozzle 510 and may free the printing substance dispensing nozzle 510 to move to the second dispensing position. As described above, the locking rod 571 may be movable in to the second unlocked position within the locking rod aperture responsive to the geometry of the receiving-side mating interface 552 interlocking with the geometry of the mechanical keying interface within the cavity.

The printing substance dispensing nozzle 510 may be locked in the first sealed position until the receiving-side mating interface 552 is fully inserted within the cavity formed by the hood 538. That is, the receiving-side mating interface 552 may include a printing substance inlet port 554 and the printing substance dispensing nozzle 510 may be locked in the first sealed position until the printing substance inlet port 554 may be aligned with the printing substance transfer aperture within the cavity. The receiving-side mating interface 552 may be fully engaged within the hood 538 when the printing substance inlet port 554 is be aligned with the printing substance transfer aperture within the cavity and the locking rod 571 is lifted into the second unlocked position within the locking rod aperture by the ramp 582. As such, the geometry of the hood 538 may block insertion of an object, without the complementary geometry to the geometry of the cavity, within the cavity and prevent the object from actuating a locking mechanism of the dispensing-side mating interface 501 to unlock the printing substance dispensing nozzle 510 from the first sealed position.

Figure 6:
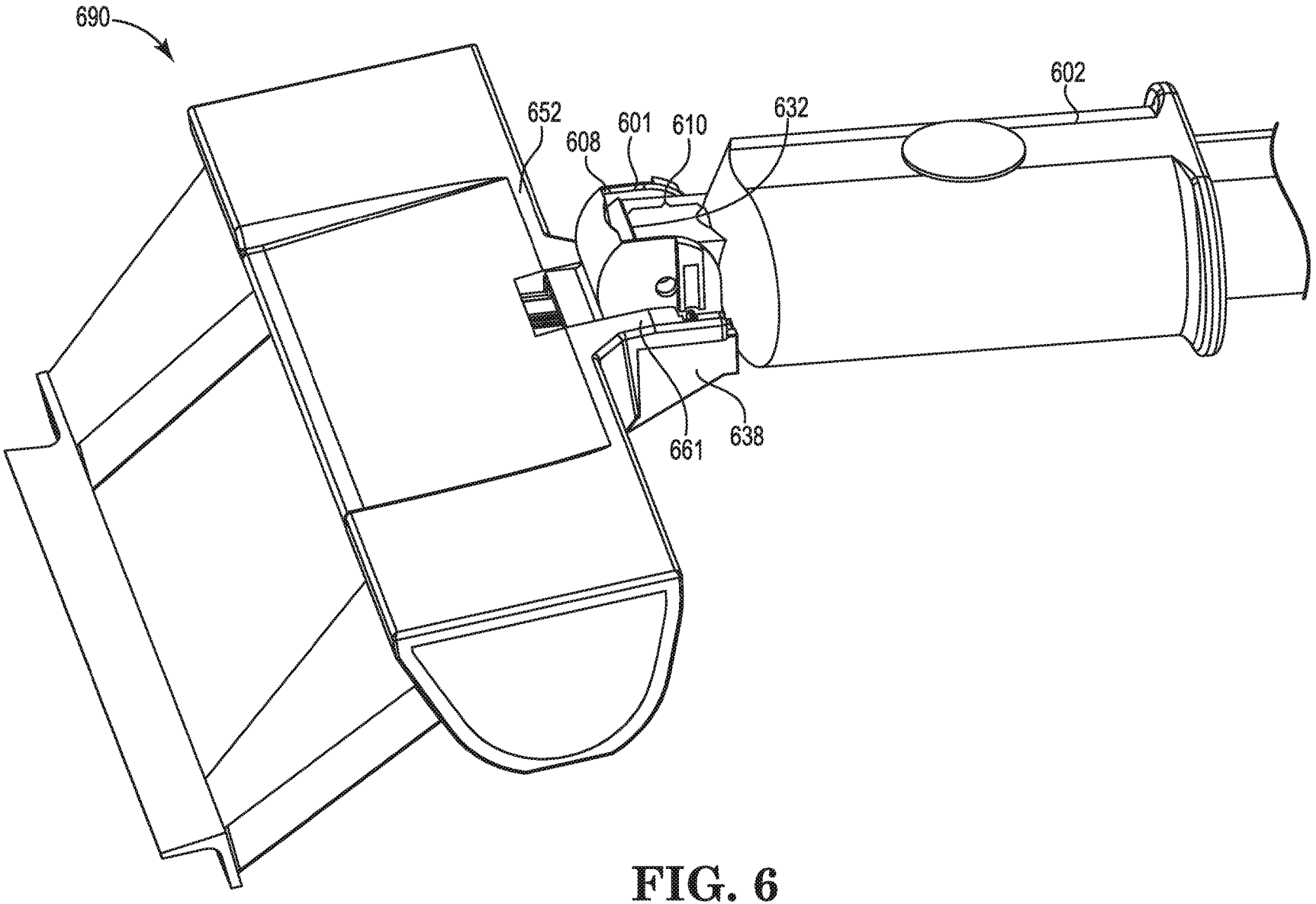
FIG. 6 illustrates a cross-sectional view of an example of a mating system for with a dispensing aperture hood consistent with the disclosure.

FIG. 6 illustrates a cross-sectional view of an example of a mating system 690 for with a dispensing aperture hood 638 consistent with the disclosure. The system 690 may include dispensing-side mating interface 601 configured to be mated to a receiving-side mating interface 652.

The system 690 may include a printing substance dispensing nozzle 610 connected to a printing substance dispensing container 602. The dispensing-side mating interface 601 may include a valve body 608. The valve body 608 may include a plurality of walls. The plurality of walls may encompass and/or define a cavity inside of the valve body 608. A portion of the printing substance dispensing nozzle 610 may be located within the cavity of the valve body 608. The dispensing-side gasket material 632 may be fixed to the portion of the printing substance dispensing nozzle 610 within the cavity. A portion of the dispensing-side gasket material 632 may protrude through a printing substance transfer window through the valve body 608.

The printing substance dispensing nozzle 610 may be movable within the valve body 608 between a first sealed position with an orifice of the printing substance dispensing nozzle 610 facing an internal face of the valve body 608 and a second dispensing position with the orifice of the printing substance dispensing nozzle 610 facing out of the printing substance transfer aperture. The printing substance dispensing nozzle 610 may be locked into the sealed position by a locking mechanism until the receiving-side mating interface 652 is fully engaged within the cavity formed by hood 638. The locking mechanism may be actuated from a locked position to an unlocked position as the receiving-side mating interface 652 is engaged within the cavity formed by hood 638. For example, ramps on the arms 661 of the receiving-side mating interface 652 may actuate the locking mechanism may be actuated from a locked position to an unlocked position as the receiving-side mating interface 652 is engaged within the cavity formed by hood 638.

The receiving-side mating interface 652 is illustrated fully engaged within the cavity defined by the hood 638 of the dispensing-side mating interface 601. In FIG. 6 a locking rod may be in an unlocked position. The unlocked position may correspond to the locking rod being present at a top portion of a ramp. The locking rod may be engaged with a catch at the top of the ramp.

In the unlocked position, the locking rod may be present in an upper portion of the window through the valve body 608 of the dispensing-side mating interface 601. In the unlocked position, the locking rod may be present in a second portion of the locking rod channel through the printing substance dispensing nozzle 610, where it no longer prevents the printing substance dispensing nozzle 610 from moving within the valve body 608 of the dispensing-side mating interface 601.

Although illustrated in the sealed orientation in FIG. 6, when the locking rod is in the unlocked position, the printing substance dispensing nozzle 610 may be in the sealed position, the dispensing position, and/or traveling between the two positions. When in the sealed position, the dispensing-side gasket material 632 may be in contact with an internal surface of a front wall of the valve body 608 sealing around the orifice. Simultaneously, a portion of the dispensing-side gasket material 632 may be protruding through a printing substance transfer window through the valve body 608 and contacting a printing substance inlet port and/or a receiving-side gasket material of the receiving-side mating interface 652. This contact may establish and/or preserve a seal around the printing substance inlet port.

When in the dispensing position, the orifice of the printing substance dispensing nozzle 610 may be aligned with the printing substance inlet port through the printing substance transfer window. The dispensing-side gasket material 632 surrounding the orifice may be in contact with the receiving-side gasket material surrounding the printing substance inlet port. This contact may establish and/or preserve a seal around the orifice of the printing substance dispensing nozzle 610, the printing substance inlet port, and/or a transfer channel existing therebetween.

When traveling between the sealed position and the dispensing position, the dispensing-side gasket material 632 may rotate against the internal surface of the front wall of the valve body 608, the printing substance inlet port, and/or the receiving-side mating interface. In this manner, a seal may be maintained against the above-mentioned components as movement occurs. Further, the dispensing-side gasket material 532 may perform a wiping function against the above-mentioned components keeping the areas free of excess printing substance and/or contaminants.

FIGS. 7A, 7B, 7C, 7D, 7E, 7F, 7G, 7H, and 7I illustrate examples of mating systems 793 with a dispensing aperture hood 738 consistent with the disclosure.

The system 793 may include a dispensing-side mating interface 701. The dispensing-side mating interface 701 may include a valve body 708. The valve body 708 may include a printing substance dispensing nozzle that is movable between a first sealed position with an orifice of the printing substance dispensing nozzle facing an internal face of the valve body 708 and a second dispensing position with the orifice of the printing substance dispensing nozzle facing a printing substance transfer aperture through the valve body 708.

The printing substance dispensing nozzle may be locked in the first position until the dispensing-side mating interface 701 is fully engage with a receiving-side mating interface 752. For example, a locking mechanism locking the printing substance dispensing nozzle from moving to a second dispensing orientation may be actuated to an unlocked state by engagement of the dispensing-side mating interface 701 is fully engage with a receiving-side mating interface 752.

Full engagement between the dispensing-side mating interface 701 and the receiving-side mating interface 752 may include the receiving-side mating interface 752 fully seating within a cavity formed by a hood 738 of the dispensing-side mating interface 701 to the extent that ramps on the receiving-side mating interface 752 lift a locking rod of the locking mechanism to an unlocked position allowing movement of the printing substance dispensing nozzle.

The hood 738 may include a plurality of walls. For example, the hood may include a first wall 740 and/or a plurality of sidewalls 741 spanning between the first wall and the valve body 708. The walls of the hood 738 may encompass and/or define a cavity between the first wall 740 and/or a plurality of sidewalls 741 spanning between the first wall and the valve body 708. In an example, the walls of the hood 738 may define a geometry of the cavity. The geometry of the cavity may limit insertion and/or full engagement of the dispensing-side mating interface 701 to receiving-side mating interfaces 752 having complementary geometries to the geometry of the hood 738 and/or the cavity.

Figure 7C:
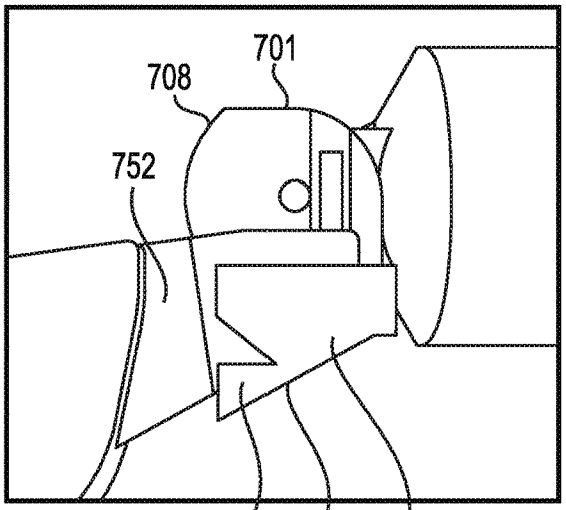
FIG. 7C illustrates an example of a mating system with a dispensing aperture hood consistent with the disclosure consistent with the disclosure.
Figure 7B:
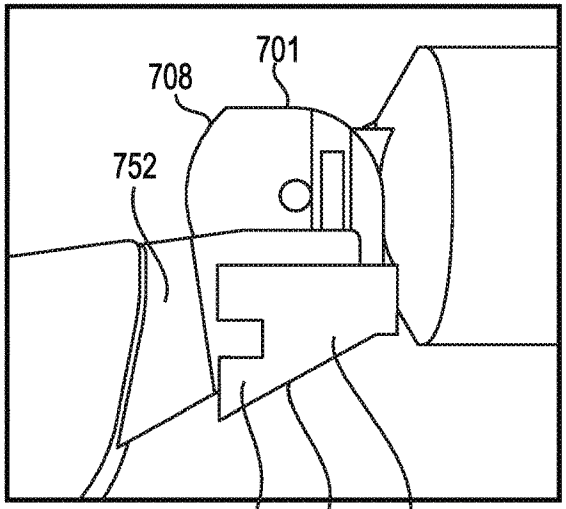
FIG. 7B illustrates an example of a mating system with a dispensing aperture hood consistent with the disclosure consistent with the disclosure.
Figure 7A:
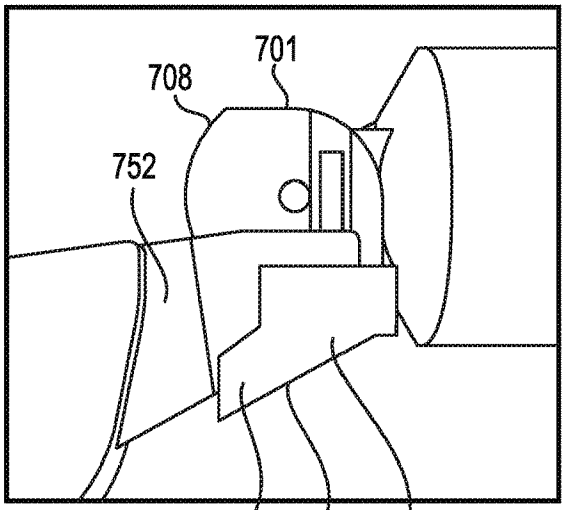
FIG. 7A illustrates an example of a mating system with a dispensing aperture hood consistent with the disclosure consistent with the disclosure.

The walls of the hood 738 may include various geometric features that serve as mechanical keying mechanisms permitting the insertion of compatible receiving-side mating interfaces 752 within their confines. For example, FIGS. 7A, 7B, and 7C illustrate side views of examples of hoods 738 with different geometric features of their sidewalls 741. The various angles and/or notches in the sidewalls 741 of the hoods 738 may interlock with complementary geometric features of compatible receiving-side mating interfaces 752. The geometric features of the sidewalls 741 may block the insertion of objects without the complementary geometry to the geometry of the hood 738 and/or cavity within the cavity thereby preventing the object from actuating a locking mechanism of the dispensing-side mating interface 701 to unlock the printing substance dispensing nozzle from the first sealed position and/or establishing stabilizing contact with each of the plurality of walls of the hood 738.

Figure 7F:
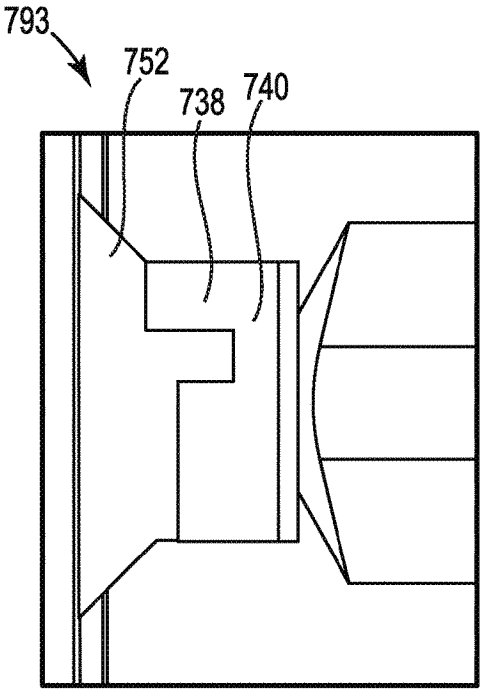
FIG. 7F illustrates an example of a mating system with a dispensing aperture hood consistent with the disclosure consistent with the disclosure.
Figure 7E:
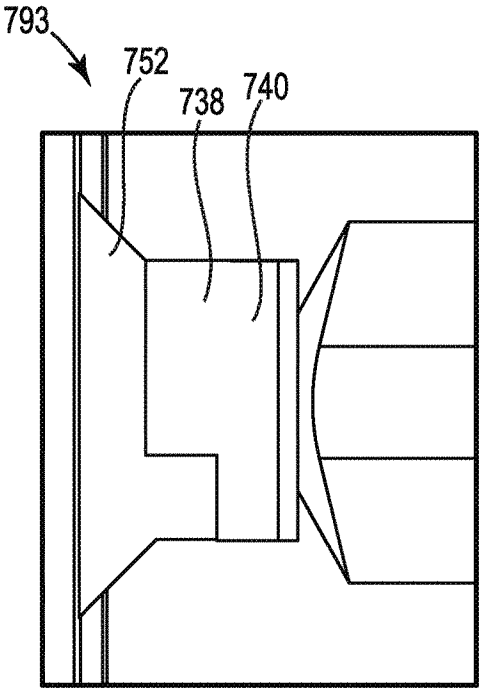
FIG. 7E illustrates an example of a mating system with a dispensing aperture hood consistent with the disclosure consistent with the disclosure.
Figure 7D:
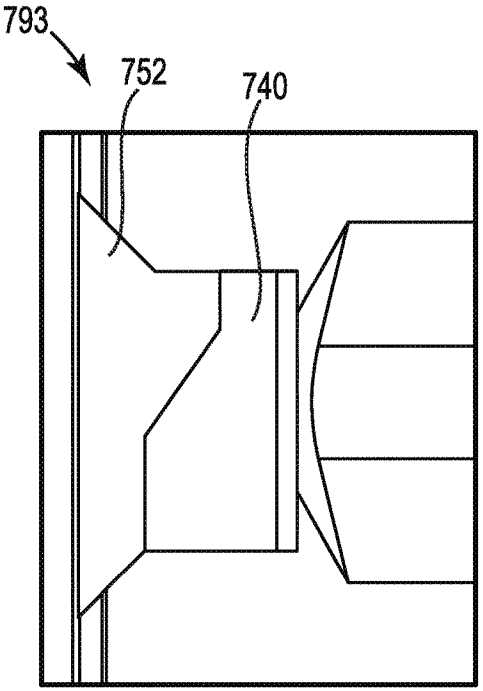
FIG. 7D illustrates an example of a mating system with a dispensing aperture hood consistent with the disclosure consistent with the disclosure.

FIGS. 7D, 7E, and 7F illustrate a bottom-up view of examples of hoods 738 with different geometric features of their first wall 740. The various angles and/or notches in the first wall 740 of the hoods 738 may interlock with complementary geometric features of compatible receiving-side mating interfaces 752. The geometric features of the first wall 740 may block the insertion of objects without the complementary geometry to the geometry of the hood 738 and/or cavity within the cavity thereby preventing the object from actuating a locking mechanism of the dispensing-side mating interface 701 to unlock the printing substance dispensing nozzle from the first sealed position and/or establishing stabilizing contact with each of the plurality of walls of the hood 738.

Figure 7I:
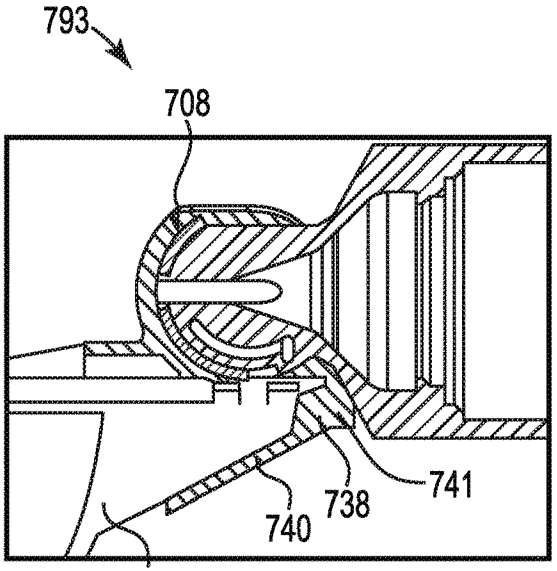
FIG. 7I illustrates a cross-sectional view of a mating system with a dispensing aperture hood consistent with the disclosure consistent with the disclosure.
Figure 7H:
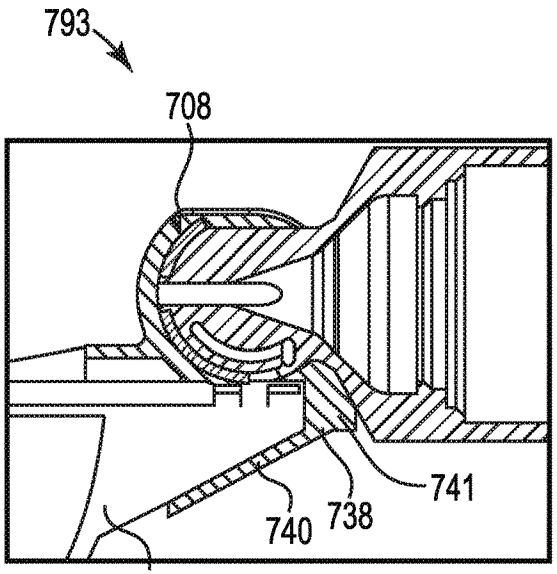
FIG. 7H illustrates a cross-sectional view of a mating system with a dispensing aperture hood consistent with the disclosure consistent with the disclosure.
Figure 7G:
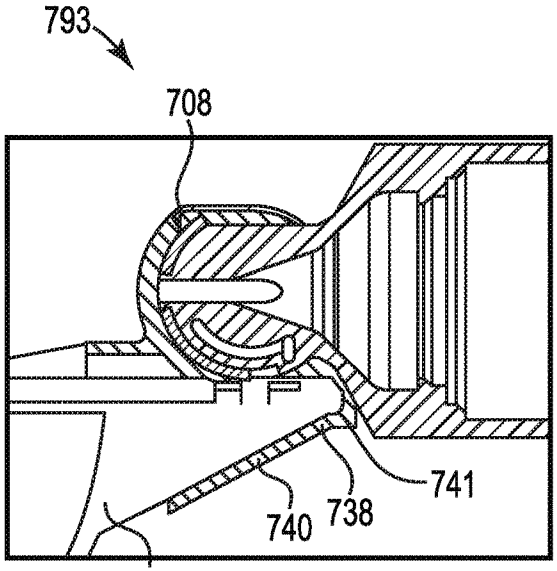
FIG. 7G illustrates a cross-sectional view of a mating system with a dispensing aperture hood consistent with the disclosure consistent with the disclosure.

FIGS. 7G, 7H, 7I illustrate a cross-sectional side-view of examples of hoods 738 with different geometric features of the internal surfaces of the walls of the hood 738 that face into the cavity formed thereby. For example, the hoods 738 may include various geometric features within the cavity that may interlock with complementary geometric features of external surfaces of compatible receiving-side mating interfaces 752. The geometric features of the inner surface of the walls of the hoods 738 may block the insertion of objects without the complementary geometry to the geometry of the hood 738 and/or cavity within the cavity thereby preventing the object from actuating a locking mechanism of the dispensing-side mating interface 701 to unlock the printing substance dispensing nozzle from the first sealed position and/or establishing stabilizing contact with each of the plurality of walls of the hood 738.

FIGS. 7A, 7B, 7C, 7D, 7E, 7F, 7G, 7H, and 7I illustrate some examples of geometries that may be utilized to implement a mechanical keying mechanism. However, examples are no so limited. Any number of complementary geometries may be utilized to implement the mechanical keying mechanism. Since the walls of the hood 738 may simultaneously contact a plurality of the walls of the receiving-side mating interfaces 752, various geometries and/or combinations of geometries may be utilized on each contacting surface to introduce various levels of complexity to the mechanical keying mechanism.

In the foregoing detailed description of the present disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the present disclosure.

The figures herein follow a numbering convention in which the first digit corresponds to the drawing figure number and the remaining digits identify an element or component in the drawing. In an example, an element such as 102 in FIG. 1 may be an example of a similar, identical, or interchangeable element with an element 202 in FIG. 2. Elements shown in the various figures herein can be added, exchanged, and/or eliminated so as to provide a plurality of additional examples of the present disclosure. The figures are not intended as limiting examples and it is contemplated that the elements depicted or described with regard to any one of them is interchangeable, applicable, and/or combinable with elements of the others. In addition, the proportion and the relative scale of the elements provided in the figures are intended to illustrate the examples of the present disclosure and should not be taken in a limiting sense. Furthermore, the terminology utilized herein referring to directionality such as up, down, side, top, bottom, etc. is utilized relative to the orientation of the drawings to provide clarity. That is, the terminology user herein may be applied without reference to the earth's surface and/or an orientation of a user relative to the system, device, and/or the earth's surface. Therefore, it is contemplated that the systems and devices described herein may be utilized in any orientation relative to the surface of the earth or a position of a user. As such, the movement of a component upward with respect to its orientation in a figure included herein may translate to a movement of the component downward with respect to the earth's surface and/or a user's orientation.

What is claimed:

1. A device, comprising:

a valve body;

a printing substance transfer aperture through the valve body;

a hood, fixed to the valve body, encompassing the printing substance transfer aperture within a cavity between an external face of the valve body and the hood;

a printing substance dispensing nozzle movable between a first position with an orifice of the printing substance dispensing nozzle facing an internal face of the valve body and a second position with the orifice of the printing substance dispensing nozzle facing the printing substance transfer aperture; and a dispensing-side gasket material slide-able through the printing substance transfer aperture when moving the printing substance dispensing nozzle between the first position and the second position.

2. The device of claim 1, wherein the hood includes a first wall opposing the external face of the valve body and a plurality of sidewalls connecting the first wall to the valve body.

3. The device of claim 2, wherein the external face of the valve body, the first wall of the hood opposing the external face of the valve body, and the plurality of sidewalls of the hood encompass an opening into the cavity.

4. The device of claim 1, wherein walls of the hood define a geometry of the cavity matched to a geometry of a receiving-side mating interface to accommodate an insertion of the receiving-side mating interface within the cavity.

5. The device of claim 1, wherein the device includes a lock mechanism to lock the printing substance dispensing nozzle in the first position.

6. The device of claim 5, wherein the lock mechanism is actuatable to unlock the printing substance dispensing nozzle from the first position responsive to insertion of a receiving-side mating interface, with a complementary geometry to a geometry of the cavity, within the cavity.

7. A device, comprising:

a valve body including a curved internal face spanning between a pair of flat internal faces;

a printing substance transfer aperture through the curved internal face of the valve body;

a shielding body to shield the printing substance transfer aperture and define a geometry of a receiving-side mating interface permitted to interface with the printing substance transfer aperture;

a printing substance dispensing nozzle, including a curved external face spanning between a pair of flat external faces, movable between a first position with an opening of the printing substance dispensing nozzle facing the curved internal face and a second position with the opening of the printing substance dispensing nozzle facing the printing substance transfer aperture; and a dispensing-side gasket material slide-able against the curved internal face of the valve body and through the printing substance transfer aperture when moving the printing substance dispensing nozzle between the first position and the second position.

8. The device of claim 7, further comprising a locking rod channel in the pair of flat external faces of the printing substance dispensing nozzle to engage a locking rod in a first portion of the locking in channel to lock the printing substance dispensing nozzle in the first position.

9. The device of claim 8, including a locking rod aperture through each face of the pair of flat external faces, wherein the locking rod aperture is dimensioned to accommodate a movement of the locking rod between a first locked position and a second unlocked position within the locking rod aperture.

10. The device of claim 9, wherein the movement of the locking rod to the second unlocked position within the locking rod aperture introduces the locking rod in to a second portion of the locking rod channel in the pair of flat external faces of the printing substance dispensing nozzle and frees the printing substance dispensing nozzle to rotate to the second position.

11. The device of claim 9, wherein the locking rod is movable in to the second unlocked position within the locking rod aperture responsive to the geometry of the receiving-side mating interface interlocking with the geometry of the shielding body.

12. A system, comprising:

a dispensing-side mating interface, including:

a valve body;

a printing substance transfer aperture through the valve body; a hood, fixed to the valve body, encompassing the printing substance transfer aperture within a cavity between an external face of the valve body and the hood;

a printing substance dispensing nozzle movable between a first position with an orifice of the printing substance dispensing nozzle facing an internal face of the valve body and a second position with the orifice of the printing substance dispensing nozzle facing out of the printing substance transfer aperture;

a dispensing-side gasket material slide-able through the printing substance transfer aperture when moving the printing substance dispensing nozzle between the first position and the second position; and a receiving-side mating interface, having a complementary geometry to a geometry of the cavity, to slide within the cavity and engage with a geometry of the hood to receive the printing substance through the printing substance transfer aperture.

13. The system of claim 12, wherein a geometry of the hood is to block insertion of an object, without the complementary geometry to the geometry of the cavity, within the cavity and prevent the object from actuating a locking mechanism of the dispensing-side mating interface to unlock the printing substance dispensing nozzle from the first position.

14. The system of claim 12, wherein the printing substance dispensing nozzle is locked in the first position until the receiving-side mating interface is fully inserted within the cavity.

15. The system of claim 12, wherein the receiving-side mating interface includes a printing substance inlet port and the printing substance dispensing nozzle is locked in the first position until the printing substance inlet port is aligned with the printing substance transfer aperture within the cavity.

* * * * *